US007677513B1

(12) United States Patent
Londo

(10) Patent No.: US 7,677,513 B1
(45) Date of Patent: Mar. 16, 2010

(54) SPIRAL/COIL WRAP STAND

(76) Inventor: Kevin C. Londo, 1820 S. Live Oak, Rockledge, FL (US) 32952

( * ) Notice: Subject to any disclaimer, the term of this patent is extended or adjusted under 35 U.S.C. 154(b) by 411 days.

(21) Appl. No.: 11/585,600

(22) Filed: Oct. 24, 2006

Related U.S. Application Data

(63) Continuation-in-part of application No. 29/263,713, filed on Jul. 28, 2006, now Pat. No. Des. 575,138.

(51) Int. Cl.
*A47B 96/06* (2006.01)

(52) U.S. Cl. ..... 248/217.1; 248/218.4; 248/230.1; 47/67; 47/86

(58) Field of Classification Search ..... 248/218.4, 248/217.1, 218.1, 104, 160, 107; 47/82, 47/83, 86, 39, 41.01, 66.6, 65.5; 211/88.03, 211/106, 112, 85.31, 107
See application file for complete search history.

(56) References Cited

U.S. PATENT DOCUMENTS

| | | | | |
|---|---|---|---|---|
| 493,161 | A | 3/1893 | Grau | |
| 3,064,933 | A * | 11/1962 | Brasty | 248/227.3 |
| 3,159,413 | A | 12/1964 | Silverman | 285/189 |
| D210,302 | S | 2/1968 | Lansford et al. | D35/3 |
| 3,740,012 | A * | 6/1973 | Millen | 248/201 |
| D300,699 | S | 4/1989 | Penrod | D6/405 |
| 5,292,014 | A | 3/1994 | Lelong | 211/88 |
| 5,394,647 | A | 3/1995 | Blackford, Jr. | 47/62 |
| 5,395,081 | A | 3/1995 | Vollink | 248/218.4 |
| 6,247,268 | B1 | 6/2001 | Auer | 47/62 |
| 6,269,589 | B1 | 8/2001 | Bouler | 47/65.5 |
| 6,508,446 | B1 * | 1/2003 | Addison et al. | 248/218.4 |
| 6,681,520 | B1 | 1/2004 | Kleinert | 47/45 |
| 6,752,279 | B1 | 6/2004 | Dwyer | 211/107 |
| 2004/0006913 | A1 | 1/2004 | Jordan | 47/86 |
| 2005/0005512 | A1 | 1/2005 | Boxsell | 47/39 |

FOREIGN PATENT DOCUMENTS

JP 02001029193 A * 2/2001

* cited by examiner

*Primary Examiner*—Gwendolyn Baxter
(74) *Attorney, Agent, or Firm*—Brian S. Steinberger; Law Offices of Brian S. Steinberger, P.A.

(57) ABSTRACT

Coil/helix shaped stands and methods of using and installing the stands that can be wrapped about elongated supports. The stands can have looped holders for supporting objects such as planters and pots, off ground level. The looped holders can be adjustable so as to remain level with different size diameter elongated supports. The stands can be aesthetically pleasing and attractive and be easy to assembly and mount. The stands are easily removable. Additionally, the coil stands can support other objects such as tables, flagpoles and umbrellas.

18 Claims, 29 Drawing Sheets

SPIRAL/COIL WRAP STAND

This invention is a continuation-in-part of U.S. Design Pat. application Ser. No. 29/263,713 filed Jul. 28, 2006 now U.S. Pat. No. D. 575,138.

FIELD OF INVENTION

This invention relates to stands and holders, in particular to stand devices, apparatus and methods for wrapping about tree trunks and tree limbs and poles and pillars and table legs and railing supports, that can be used for holding and displaying pots, planters, flowers, plants, bird seed, tables, beverages and food items and other objects off the ground.

BACKGROUND AND PRIOR ART

Backyards and gardens have become increasingly popular to display plants and flowers in pots and planters. Attempts have been made to display pots and plants that have included ground based stands and elevated supports. Many of these stands can require assembly time and be expensive to purchase and assemble, as well as be unsightly and unattractive. In addition, such stands take up valuable ground space which restricts use and enjoyment of backyards and gardens. For example, townhouses, and many new homes, have small backyards that do not allow for the display of many planters and pots. Thus, ground based stands are undesirable.

Since ground coverage can be limited in small environments it can be desirable to elevate pots and planters to gain valuable ground space with elevated supports. However, elevating pots and planters has required one to use hooks and other fasteners, such as tight bands and wires and chains (rust, etc.), that can have inherent problems. For example, fastening the hooks to structures such as porches, and the like, as well as to fences and even trees, requires labor and extra materials such as but not limited to hooks, and other fasteners, that must be carefully mounted.

In addition, such fasteners, that use nails and screws, and/or tight bands, wires, etc., can also cause permanent damage to those supports when they are being attached. While it may be possible to fix underlying supports such as porch columns and fences, natural supports such as trees, are generally not replaceable and can become permanently scarred and damaged. Often these hook and band type fasteners form permanent attachments to underlying structures and can not be reusable.

Additionally, many stands can require extensive material cost and time to assemble, and also can result in unsightly and unattractive supports that are not desirable for displaying pots and planters of flowers and plants.

Various types of supports have been proposed over the years, some of which are shown in U.S. Pat. Nos. 493,161 to Grau; 3,159,413 to Silverman; 5,292,014 to Lelong; 5,295,081 to Vollink; 5,394,647 to Blackford, Jr.; 6,247,268 to Auer; 6,269,589 to Bouler; 6,681,520 to Kleinert; 6,752,279 to Dwyer; and Des. 210,302 to Lansford; and U.S. Published Patent Applications: 2004/0006913 to Jordan and 2005/0005512 to Boxsell. However, these supports are no better than those previously mentioned and do not overcome all the problems with the prior art.

Thus, the need exists for solutions to the above problems with the prior art.

SUMMARY OF THE INVENTION

A primary objective of the present invention is to provide stand and holder devices, apparatus and methods for wrapping about underlying supports such as tree trunks and tree limbs and poles and pillars and table legs and railing supports, in order to hold and display pots, planters, flowers, plants, bird seed, tables, beverages and food items and other objects off the ground.

A secondary objective of the present invention is to provide stand and holder devices, apparatus and methods for wrapping about underlying supports such as tree trunks and tree limbs and poles and pillars and table legs and railing supports, in order to hold and display pots, planters, flowers, plants, bird seed, tables, beverages and food items, that can easily be attached to the underlying supports.

A third objective of the present invention is to provide stand and holder devices, apparatus and methods for wrapping about underlying supports such as tree trunks and tree limbs and poles and pillars and table legs and railing supports, in order to hold and display pots, planters, flowers, plants, bird seed, tables, beverages and food items and other objects, that does not cause any damage and/or scarring to the underlying supports.

A fourth objective of the present invention is to provide stand and holder devices, apparatus and methods for wrapping about underlying supports such as tree trunks and tree limbs and poles and pillars and table legs and railing supports, in order to hold and display pots, planters, flowers, plants, bird seed, tables, beverages and food items and other objects, that is reusable.

A fifth objective of the present invention is to provide stand and holder devices, apparatus and methods for wrapping about underlying supports such as tree trunks and tree limbs and poles and pillars and table legs and railing supports, in order to hold and display pots, planters, flowers, plants, bird seed, tables, beverages and food items, that is inexpensive in material coasts and does not require extra labor time to assemble.

A sixth objective of the present invention is to provide stand and holder devices, apparatus and methods for wrapping about underlying supports such as tree trunks and tree limbs and poles and pillars and table legs and railing supports, in order to hold and display pots, planters, flowers, plants, bird seed, tables, beverages and food items, that is attractive in appearance and adds aesthetically to the surroundings in which it is used.

A novel stand for supporting objects above ground level, that can include a coil/helix shaped member that is adaptable to wrap in a spiral configuration about an elongated underlying support, and a holder attached to the coil member for supporting an object above ground level. The stand is generally rigid but can be slightly flexed to wrap tightly about the elongated underlying support. The stand can include looped holders to support the objects above the ground level.

The coil/helix shaped member can be formed from materials such as PVC, ABS plastic, polycarbonate, PPSF and blends, complex materials, wood, fiberglass, ceramics, glasses, polymers, electropositive elements (chrome, electroplated materials), and/or metals, various combinations thereof, and the like, with interconnected components. Connections can be by slip on components. Alternatively, connections be threaded to one another still furthermore, connections can include compression fittings, and the like. The stand can also be formed from a single piece of molded plastic.

Objects that can be supported by the loop holders can include pots and planters. Additional objects to be supported can include beverage containers such as cans, bottles and glasses. The stand can also support tables. Still furthermore, objects that are supported can include flag poles and umbrellas.

The underlying support can be either or both vertical, horizontal or angled tree trunks and a tree limbs. Still furthermore the underlying support can be poles and posts. Still furthermore the underlying support can be railings and banisters. Still furthermore the underlying support can be vertical columns, pillars and vertical uprights.

The invention can include a novel method of attaching the coil stand about an elongated underlying member to support objects above ground level, by wrapping the coil shaped member about an elongated underlying member that is above a ground level, and placing objects on portions of the coil shaped member so that the objects are positioned above the ground level.

The wrapping step can include steps of orienting the coil shaped member so that its' longitudinal axis is perpendicular to the longitudinal axis of the elongated member, moving the coil shaped member so that a mid portion of the member abuts against a portion of the elongated underlying member, and twisting/turning the coil shaped member to wrap substantially about the elongated underlying member so that the longitudinal axis of the coil shaped member is substantially parallel to the longitudinal axis of the elongated underlying member.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The components of the figures are defined and listed below.

Figure 2:
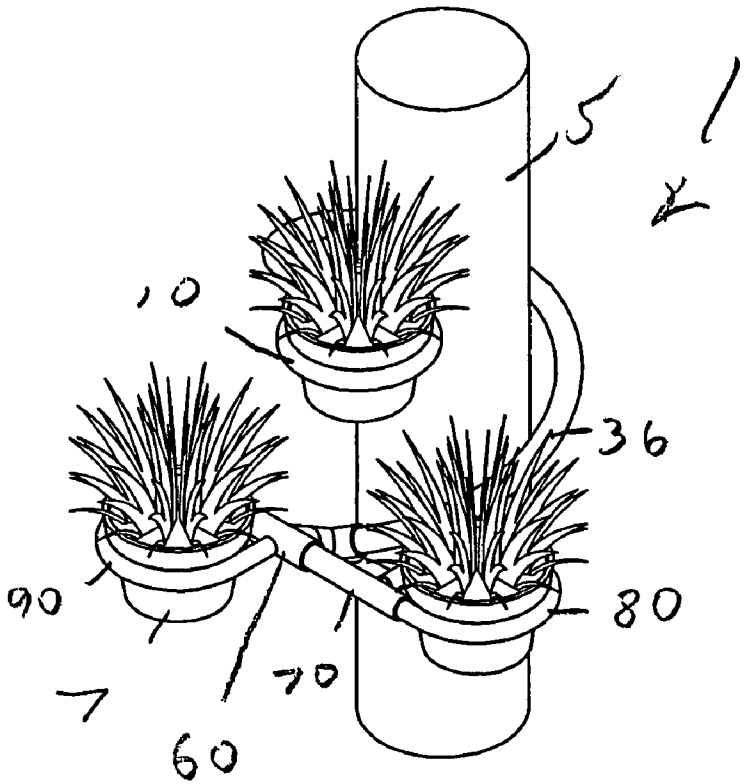
FIG. 2 is a front right perspective view of the embodiment of FIG. 1.
Figure 1:
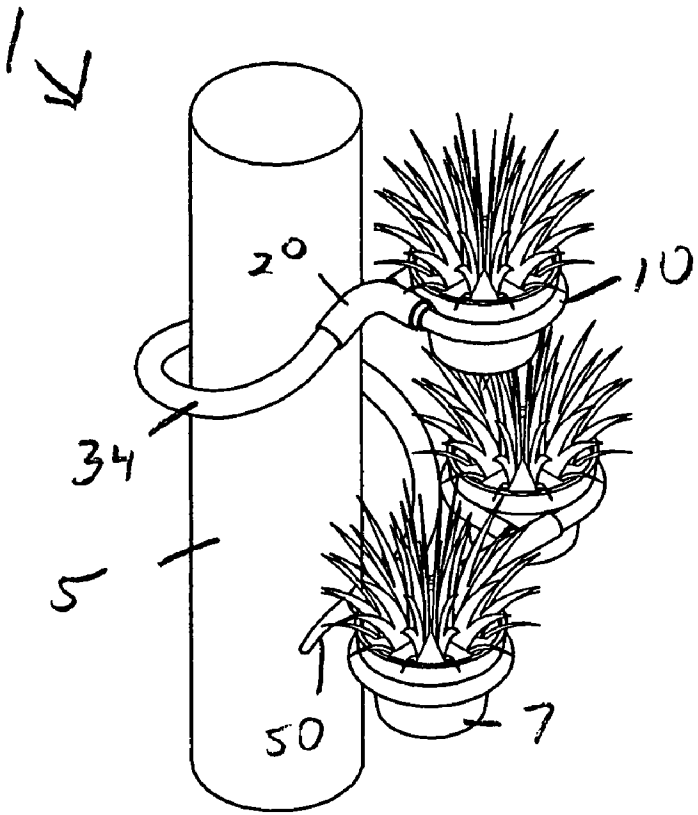
FIG. 1 is a front left perspective view of the coil stand mounted to an elongated support holding potted plants.
Figure 4:
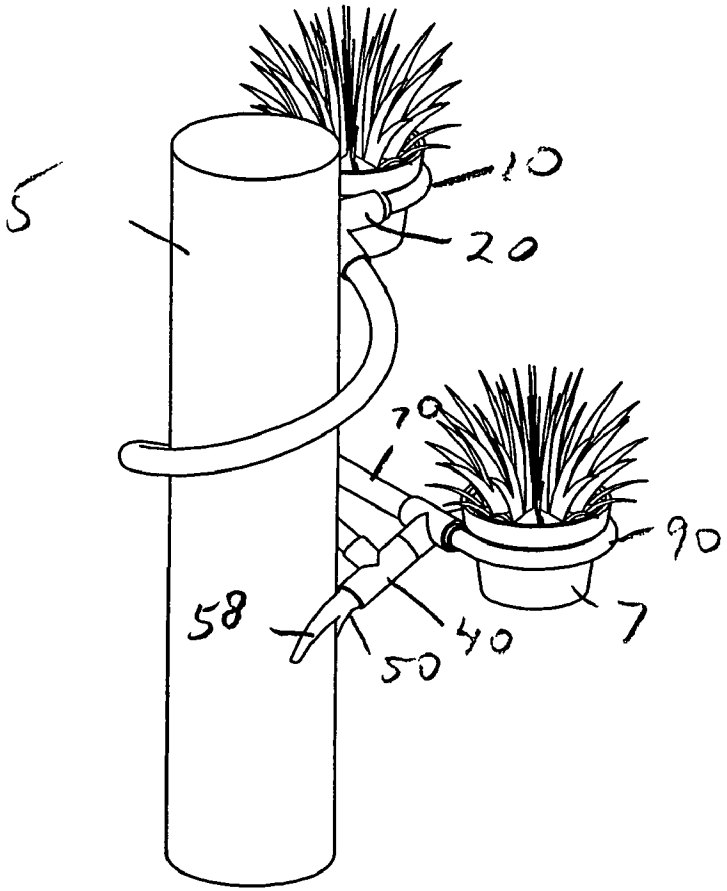
FIG. 4 is a rear right perspective view of the embodiment of FIG. 1.
Figure 3:
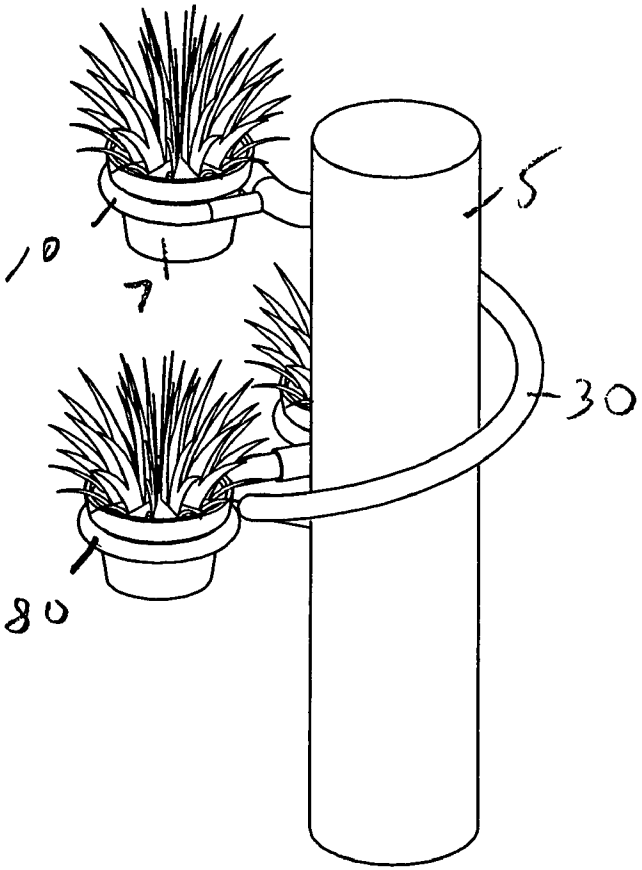
FIG. 3 is a rear left perspective view of the embodiment of FIG. 1.
Figure 6:
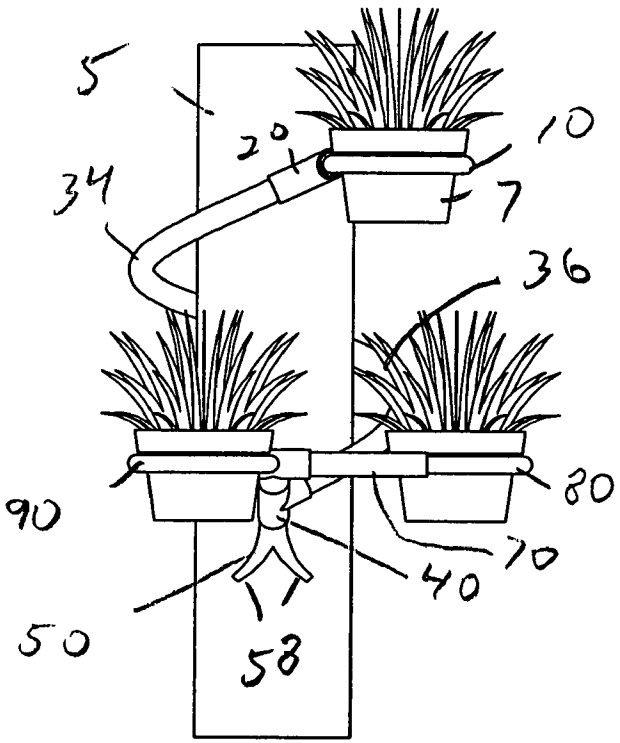
FIG. 6 is a front view of the embodiment of FIG. 1.
Figure 5:
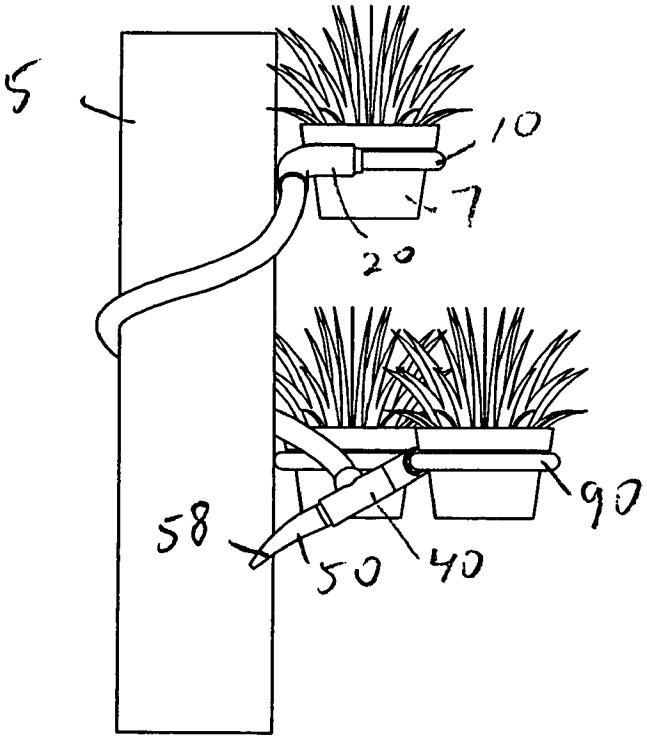
FIG. 5 is a left side view of the embodiment of FIG. 1.
Figure 8:
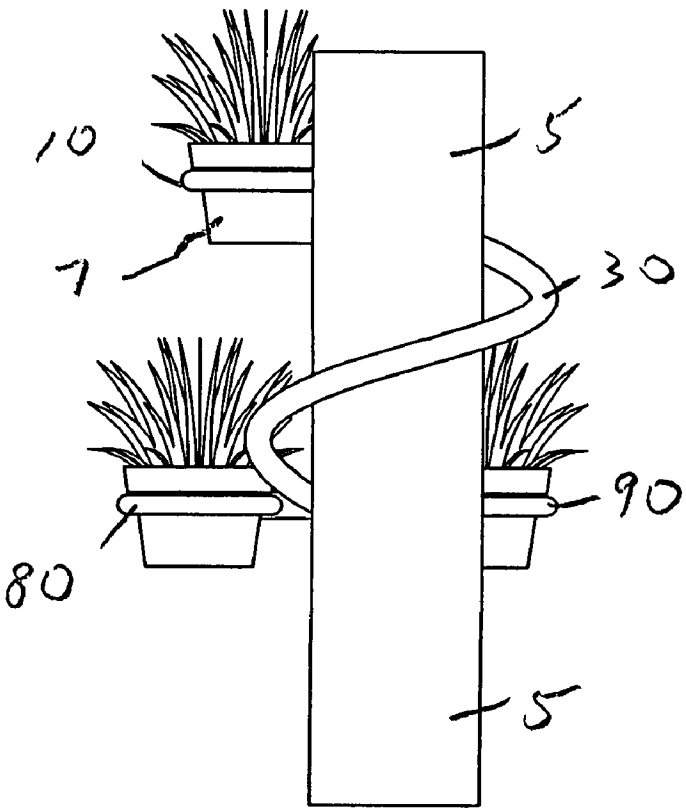
FIG. 8 is a rear view of the embodiment of FIG. 1.
Figure 7:
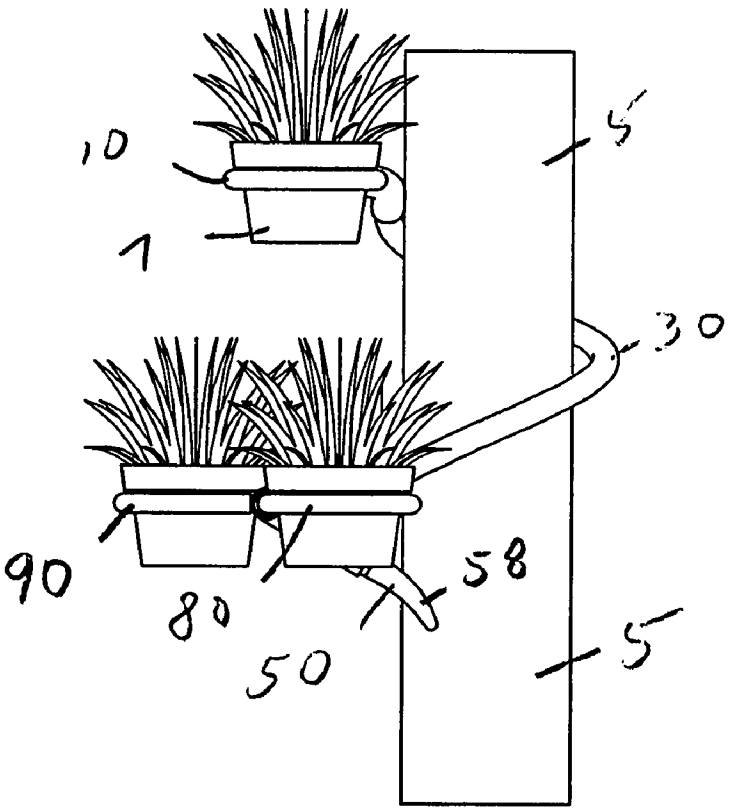
FIG. 7 is a right view of the embodiment of FIG. 1.
Figure 10:
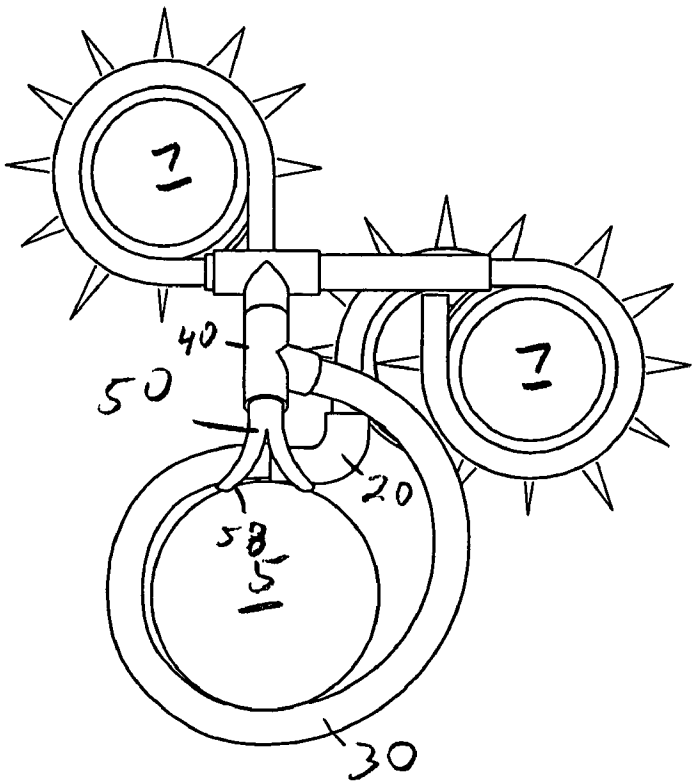
FIG. 10 is a bottom view of the embodiment of FIG. 1.
Figure 9:
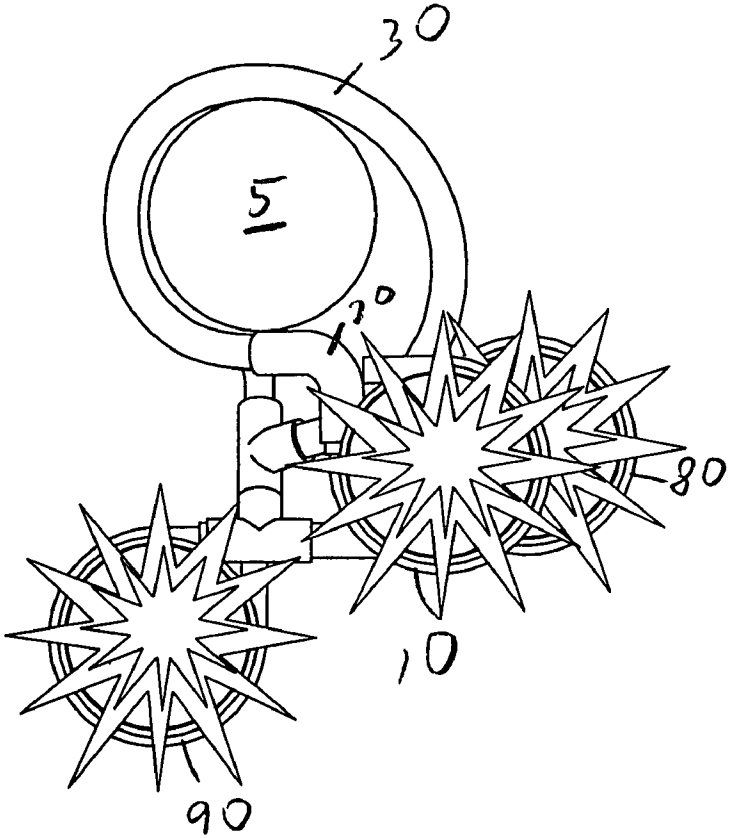
FIG. 9 is a top view of the embodiment of FIG. 1.

1. coil stand wrapped about underling member supporting planter objects
5 elongated underlying support member
7 potted plant object
10 top loop holder
20 bent coupler
30 main elongated coil/helix member
32 upper coil end
34 upper curved bend
36 lower curved bend
38 lower coil end
40 bottom end t-shaped coupler
50 fork stabilizer
58 prong ends
60 t-coupler for bottom loop holders
70 extension coupler
80 bottom right loop holder
82 outer end
88 attachment end
90 bottom left loop holder
92 outer end
98 attachment end
150 spike
152 connector end
158 angled/sharpened outer end
250 yoke
252 connector end
255 pad
256 curved edge
200 Second stand
210 lower loop holder
220 curved coupler
240 t-shaped coupler
260 t-shaped coupler
270 extender coupler
280 upper left loop holder
290 upper right loop holder
300 molded single piece stand
310 upper loop holder
380 bottom left loop holder
390 bottom right loop holder
400 stabilizer extender embodiment
440 t-shaped coupler
450 fork stabilizer
452 elongated end of stabilizer
460 modified t-shaped coupler
465 pass-through opening
500 table and flag holder embodiment
510 flag and pole
520 table
522 lower extending portion
530 beverage/food products
528 lower extending portion
550 stabilizer
552 upper hollow end of stabilizer FIG. 1 is a front left perspective view of the coil stand 1 mounted to an elongated underlying support member with the stand holding potted plants 7. FIG. 2 is a front right perspective view of the embodiment 1 of FIG. 1. FIG. 3 is a rear left perspective view of the embodiment 1 of FIG. 1. FIG. 4 is a rear right perspective view of the embodiment 1 of FIG. 1. FIG. 5 is a left side view of the embodiment 1 of FIG. 1. FIG. 6 is a front view of the embodiment 1 of FIG. 1. FIG. 7 is a right view of the embodiment 1 of FIG. 1. FIG. 8 is a rear view of the embodiment 1 of FIG. 1. FIG. 9 is a top view of the embodiment 1 of FIG. 1. FIG. 10 is a bottom view of the embodiment 1 of FIG. 1.

Figure 12:
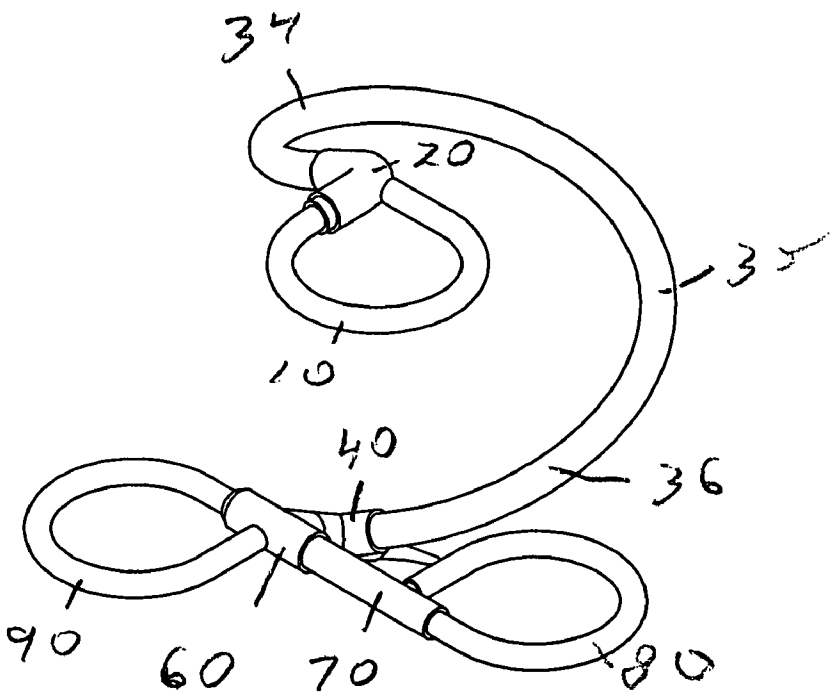
FIG. 12 is a front right perspective view of the coil stand of FIG. 11.
Figure 11:
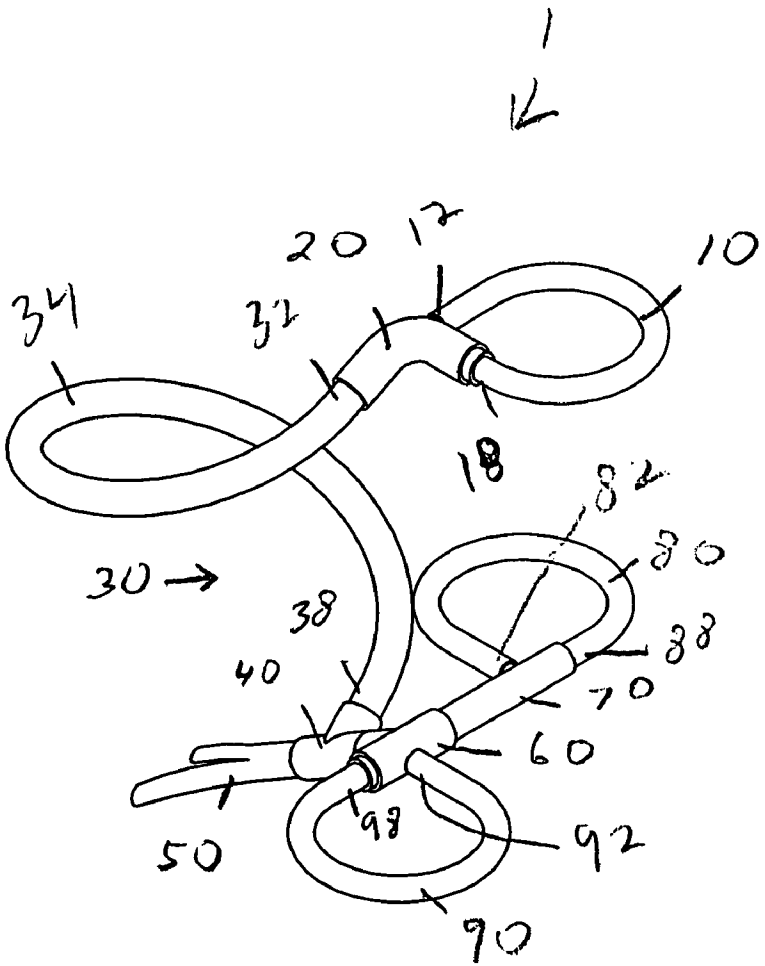
FIG. 11 is a front left perspective of the coil stand of FIG. 1 by itself without the underlying support and potted plant objects.
Figure 14:
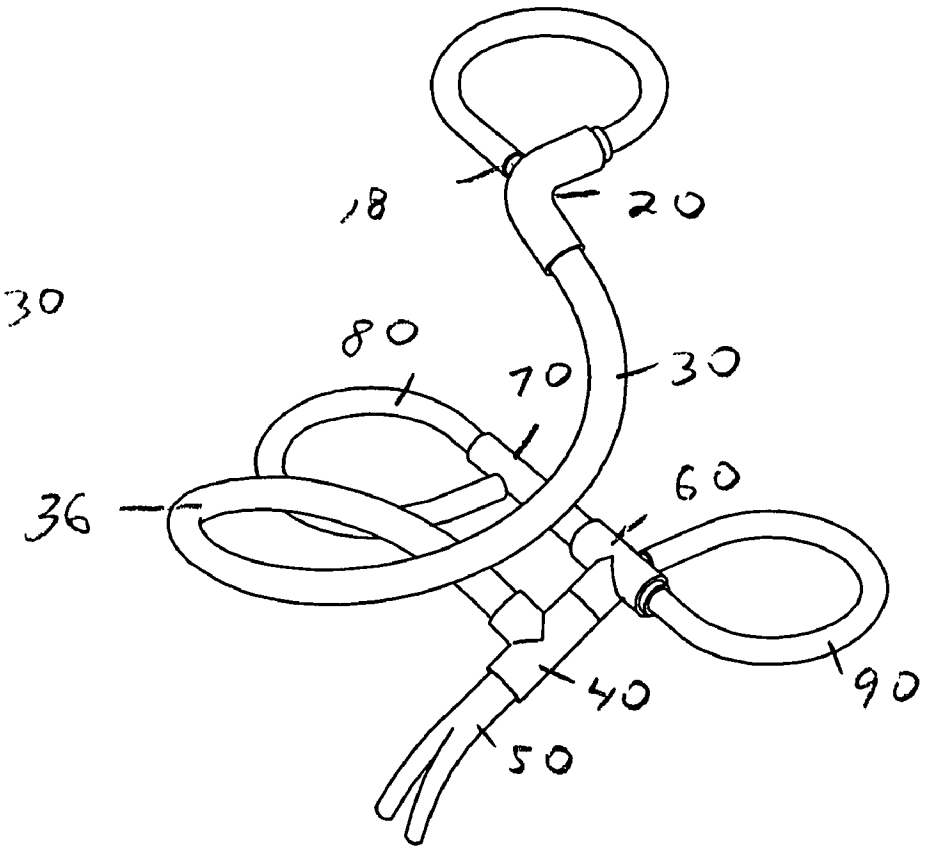
FIG. 14 is a rear right perspective view of the coil stand of FIG. 11.
Figure 13:
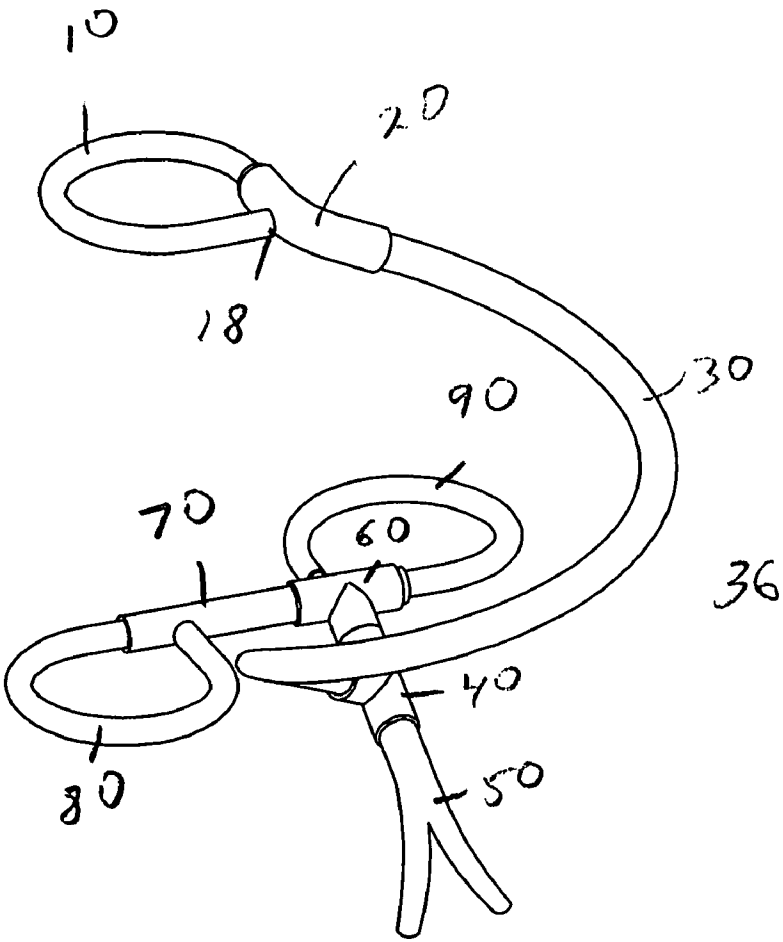
FIG. 13 is a rear left perspective view of the coil stand of FIG. 11.
Figure 16:
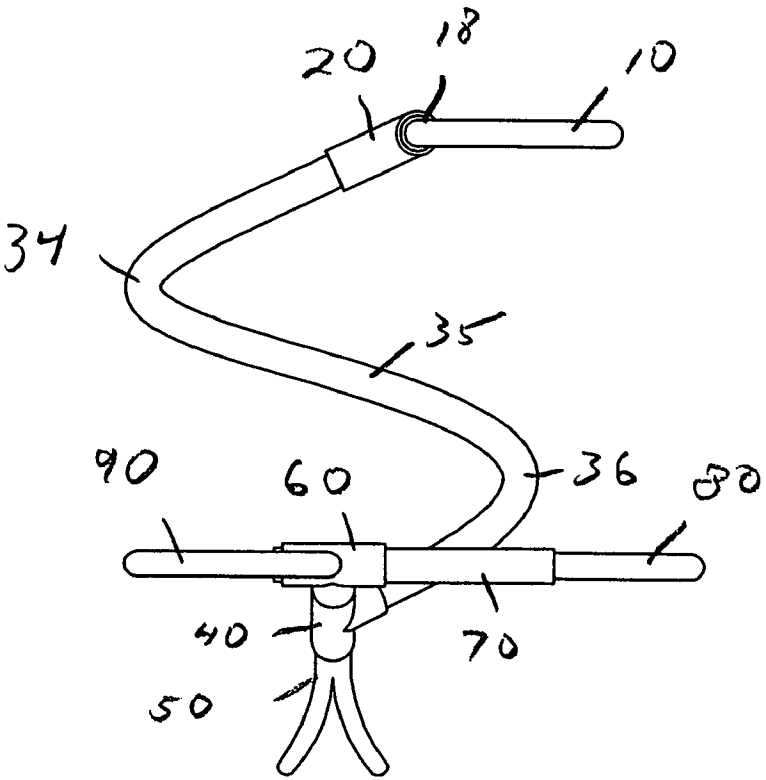
FIG. 16. is a front view of the coil stand of FIG. 11.
Figure 15:
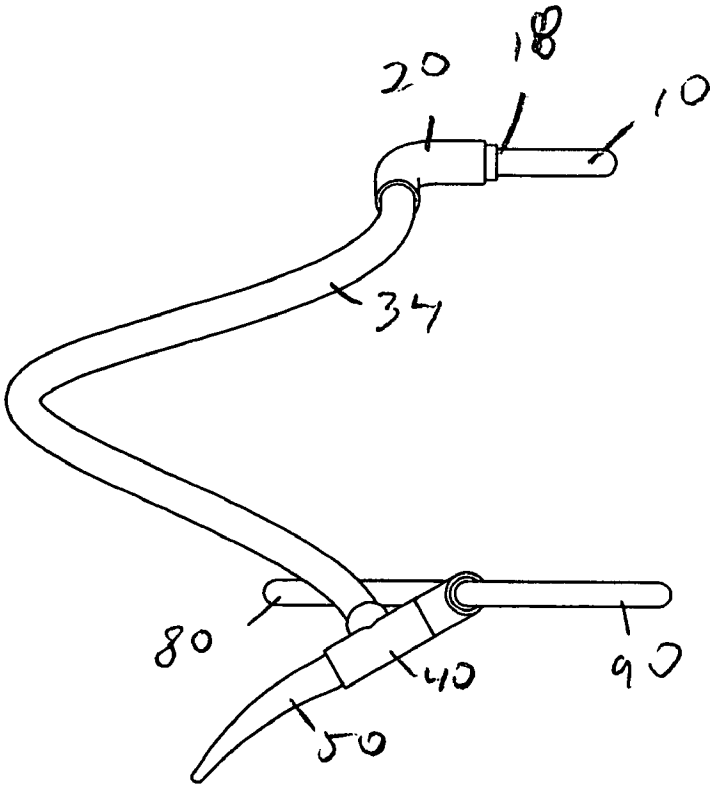
FIG. 15 is a left side view of the coil stand of FIG. 11.
Figure 18:
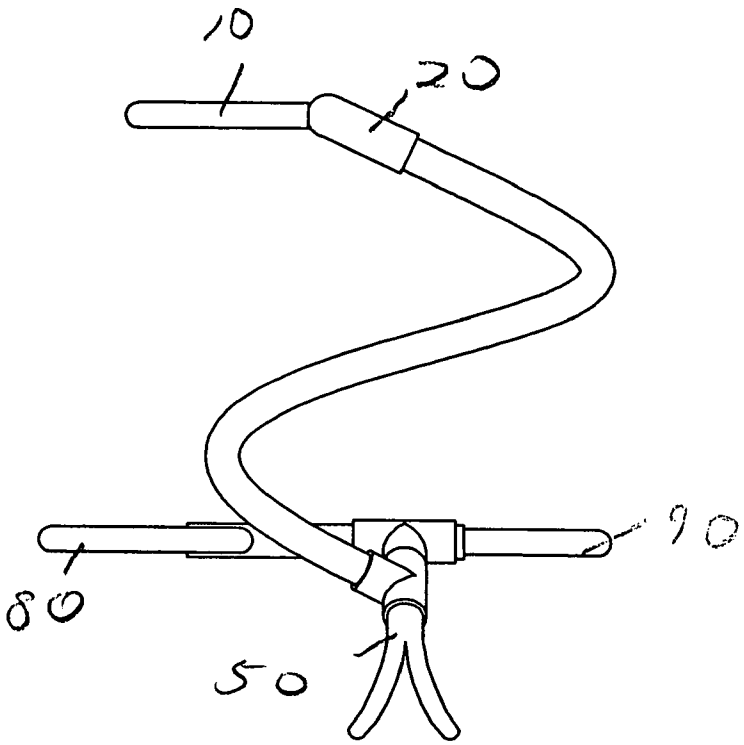
FIG. 18 is a rear view of the coil stand of FIG. 11.
Figure 17:
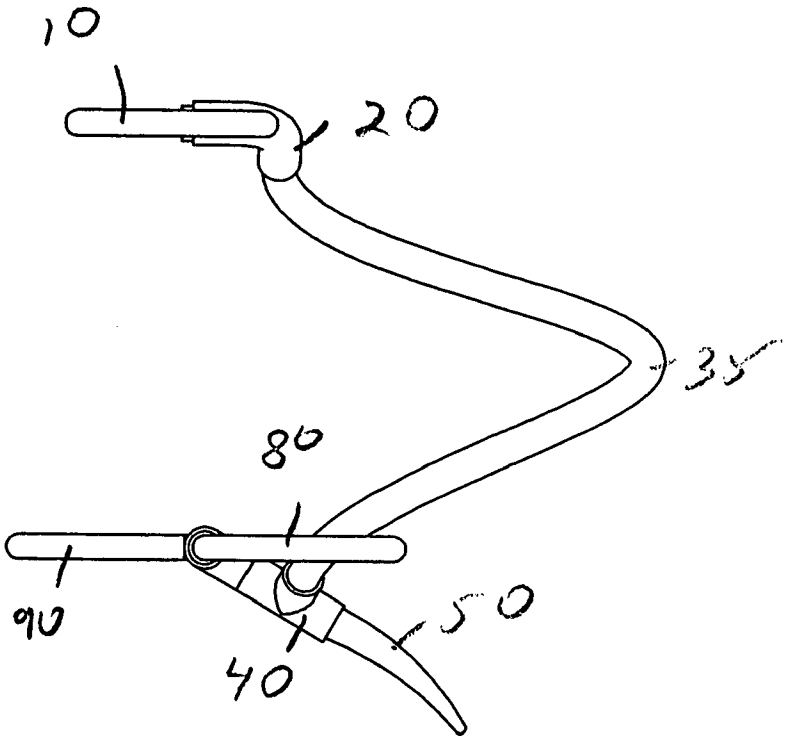
FIG. 17 is a right side view of the coil stand of FIG. 11.
Figure 20:
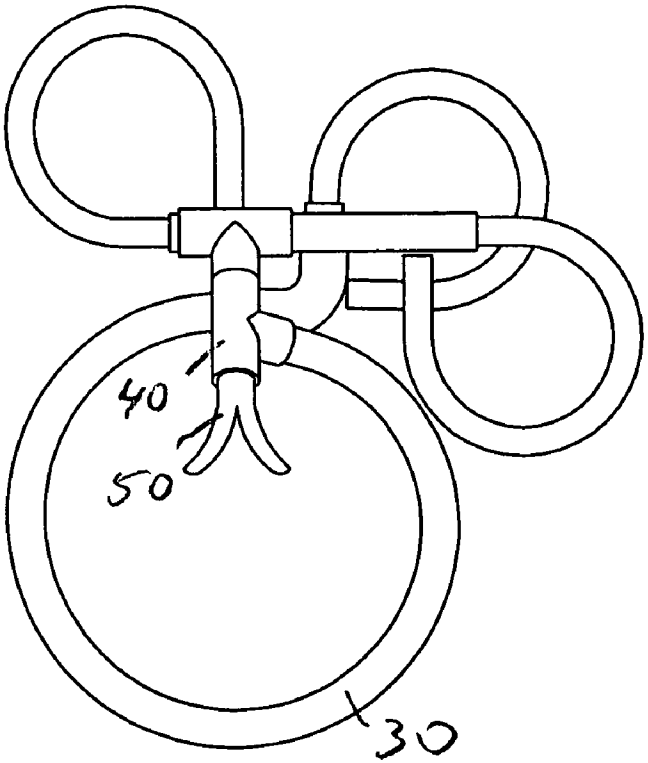
FIG. 20 is a bottom view of the coil stand of FIG. 11.
Figure 19:
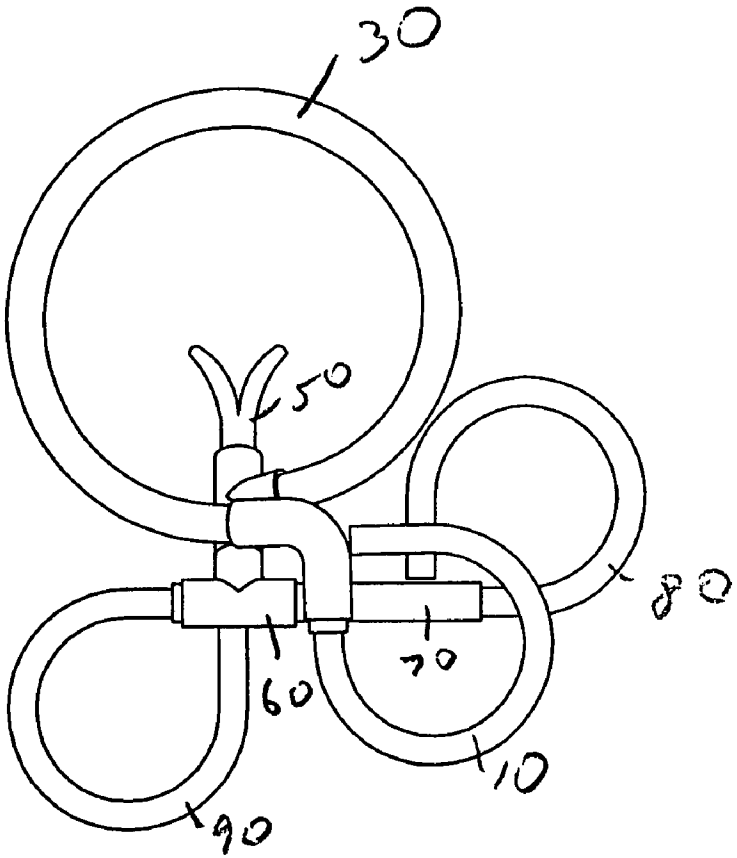
FIG. 19 is a top view of the coil stand of FIG. 11.

FIG. 11 is a front left perspective of the coil stand 1 of FIG. 1 without the underlying support member 5 and potted plant objects 7 depicted in the previous figures. FIG. 12 is a front right perspective view of the coil stand 1 of FIG. 11. FIG. 13 is a rear left perspective view of the coil stand 1 of FIG. 11. FIG. 14 is a rear right perspective view of the coil stand 1 of FIG. 11. FIG. 15 is a left side view of the coil stand 1 of FIG. 11. FIG. 16. is a front view of the coil stand 1 of FIG. 11. FIG. 17 is a right side view of the coil stand 1 of FIG. 11. FIG. 18 is a rear view of the coil stand 1 of FIG. 11. FIG. 19 is a top view of the coil stand 1 of FIG. 11. FIG. 20 is a bottom view of the coil stand 1 of FIG. 11.

Referring to FIGS. 1-20, an embodiment of the invention can include a novel main elongated coil generally cylindrical pipe shaped member 30 having an upper coil end 32 that slopes down to an upper left curved bend 34 with generally concave surface facing right, a middle portion 35 that leads to a lower right curved bend 36 with a concave surface facing left, and a bottom lower coil end 38. Main elongated coil member 30 can have a longitudinal axis between upper coil end 32 and lower coil end 38 generally running down the middle of upper curved bend 34 and lower curved bend 36.

When assembled, the stand 1 can include a top loop holder 10 that forms a generally planar loop of a generally pipe shaped body with outer end 12 and attachment end 18, that can be used to support and hold an object such as a potted plant 7 inside. The attachment end can tightly slip into one end of a bent coupler 20 such as a ninety degree angled coupler. The opposite end of the coupler 20 can receive the upper coil end 32 of the main elongated coil member 30.

The lower coil end 38 of the main coil member 30 can slip fit into the middle opening of the bottom end t-shaped coupler 40, with an attachment end of the fork stabilizer 50 slip fit into one end opening of the t-shaped coupler 40 and a middle opening end of a second t-shaped coupler 60 that can slip fit with an opposite opening of the t-shaped coupler 40. One end of the second t-shaped coupler 60 can be slip fit with the attachment end 98 of bottom left loop holder 90, with the opposite end of the second t-shaped coupler 60 being slip fit with one end of an extension coupler 70 and the opposite end of the extension coupler 70 being slip fit with attachment end 88 of bottom right loop holder 80. Coupler 70 can slide through t-shaped coupler 40 to be on either side of the coupler 40. Each of the bottom loop holders 80, 90 can be similar in shape to the top loop holder 10 by having planar loop configurations with respective outer ends 82, 92 that form a loop shape.

Installing the novel stand will now be described. The novel coil shaped stand 1 can be installed on a variety of elongated members 5 such as around natural live structures such as tree trunks and tree limbs. The underlying elongated supper members 5 can also include manmade members such as poles and a posts. Other underlying support members can include a vertical columns, pillars and other vertical uprights used on structures such as porches, overhangs, and buildings. Additionally, the elongated underlying support can include railings and banisters.

Figure 22:
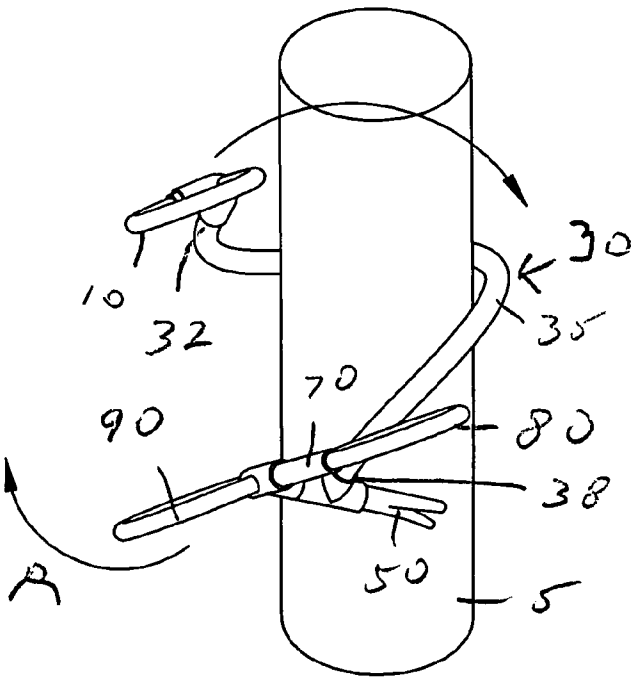
FIG. 22 shows the novel stand being twisted about the underlying support member.
Figure 21:
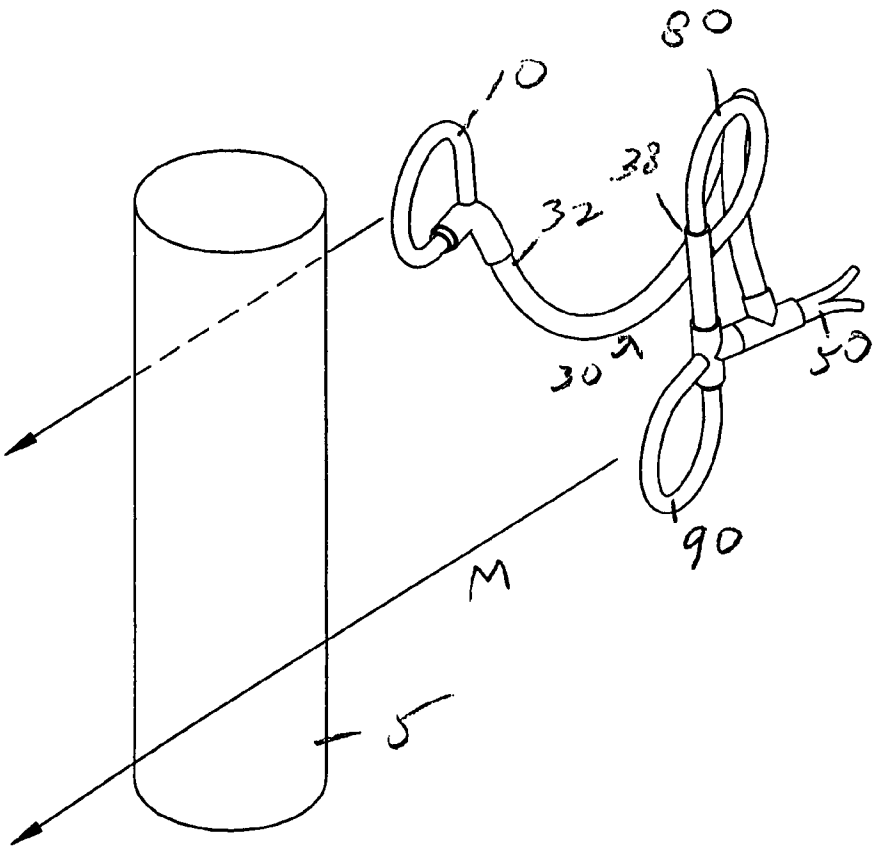
FIG. 21 shows a view of the novel stand of the preceding figures oriented to be installed onto the underlying support member.
Figure 24:
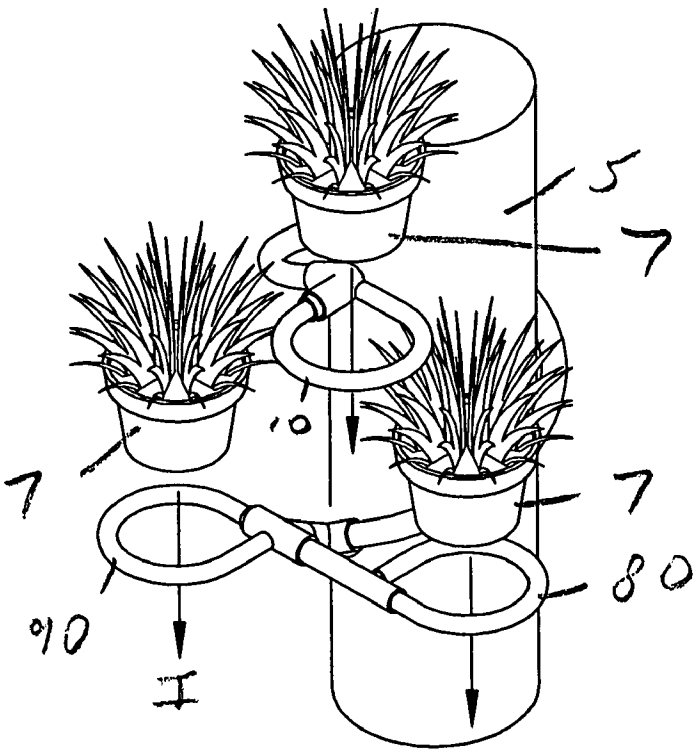
FIG. 24 shows potted plants being positioned into the loop holders of the novel stand.
Figure 23:
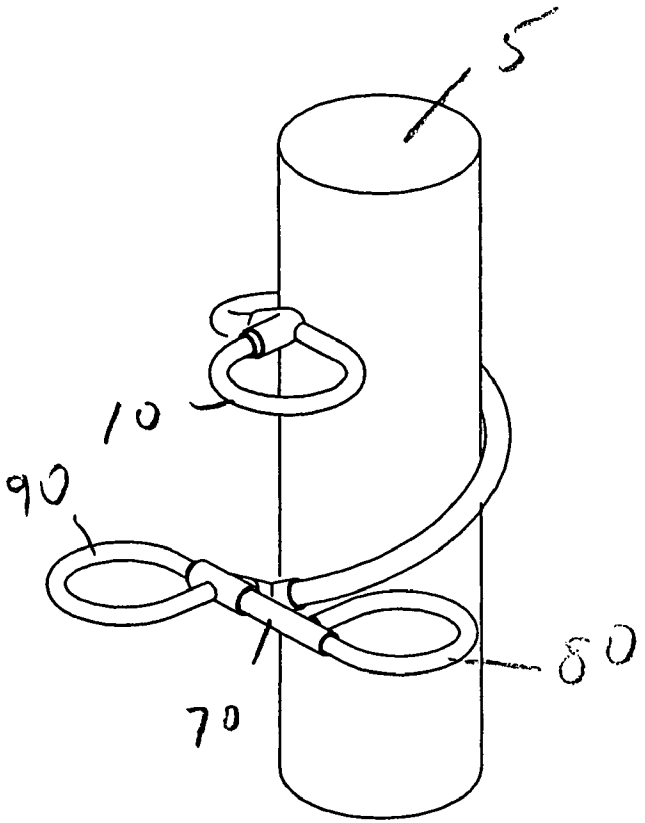
FIG. 23 shows the novel stand of FIG. 22 after being twisted to a final position on the underlying support member.

FIG. 21 shows a view of the novel stand 1 of the preceding figures oriented to be installed onto the underlying support member 5. FIG. 22 shows the novel stand being twisted about the underlying support member 5. FIG. 23 shows the novel stand 1 of FIG. 22 after being twisted to a final position on the underlying support member 5. FIG. 24 shows potted plants 7 being positioned into the loop holders 10, 80 and 90 of the novel stand 1.

Referring to FIGS. 21-24, a novel methodology of attaching the stand 1 about an elongated underlying member 5 to support objects 7 above ground level, can include initially orienting the coil shaped member 30 so that its' longitudinal axis between ends 32, 38 to be generally perpendicular to the longitudinal axis of the elongated member 5. Next, the stand 1 can be moved in the direction of arrow M toward the underlying member 5 so that the mid portion 35 of the coil shaped member 30 rests adjacent to a side of the underlying member 5, with top loop holder 10 to one side of the underlying member 5 and bottom loop holders 80, 90 to an opposite side of the underlying member 5. Next the stand 1 can be twisted/rotated or turned clockwise in the direction of arrow R so that the coil shaped member 30 is able to wrap substantially about the elongated underlying support member 5 so that the longitudinal axis of the coil shaped member 30 is substantially parallel to the longitudinal axis of the elongated underlying member 5.

The stand 1 can be stabilized by either or both of the prong ends 58 of the fork stabilizer 50 pressing and abutting against a surface portion of the underlying support member 5, as shown in FIGS. 4-7, and 10. The fork stabilizer 50 can also adjusted to telescoping fit into the t-shaped coupler 40 so as to be able to extend firmly against the underlying support member 5.

Additionally, curved portions of the coil member 30 can also press and abut against surface portions of the underlying support member 5 to further stabilize and tightly hold the stand 1 to the underlying support member as shown in FIGS. 5, 7 and 10. The stand 1 while substantially rigid has some flexing to allow the stand 1 to be slightly flexed to tightly wrap about both different diameter cylindrical and non-cylindrical underlying support members 5.

The final installation can include taking objects such as plant and flower pots 7 and inserting the objects downward in the direction of arrow I into each of the loop holders 10, 80 and 90. The pots 7 can have raised upper edge-ridges to allow them to be supported within the loop holders 10, 80, 90. Alternatively, the pots can be slightly conical shaped so as to also be supported within the loop holders 10, 80 and 90.

Figure 25:
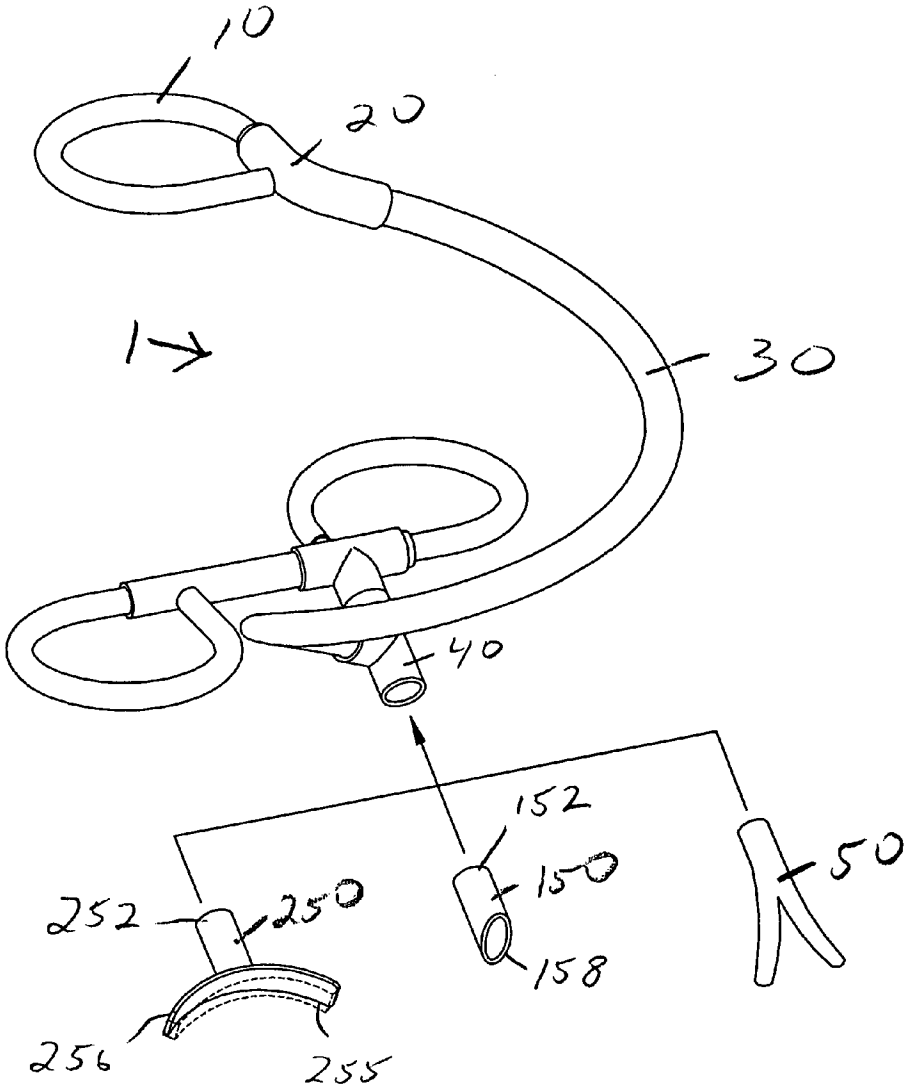
FIG. 25 shows an exploded perspective view showing different stabilizing components.

FIG. 25 shows an exploded perspective view showing different stabilizing components. In addition to using a telescoping connected fork 50, other stabilizing components such as a yoke shaped component 250 having a telescoping connecting end 252 and an outer curved surface 256 of variable radius for different diameter support members, that can wrap about a curved surface on an underlying support member can be used. In addition, a pad 255, such as a but not limited to silicon, rubber or foam pad can be used to both protect the underlying support member 5 and allow for a tighter fit of the installed stand 1. Another stabilizing component can include a spike 150 also having a telescoping connection end 152 and an outer angled or sharpened end 158, the latter of which can press against the underlying support member 5.

Figure 26:
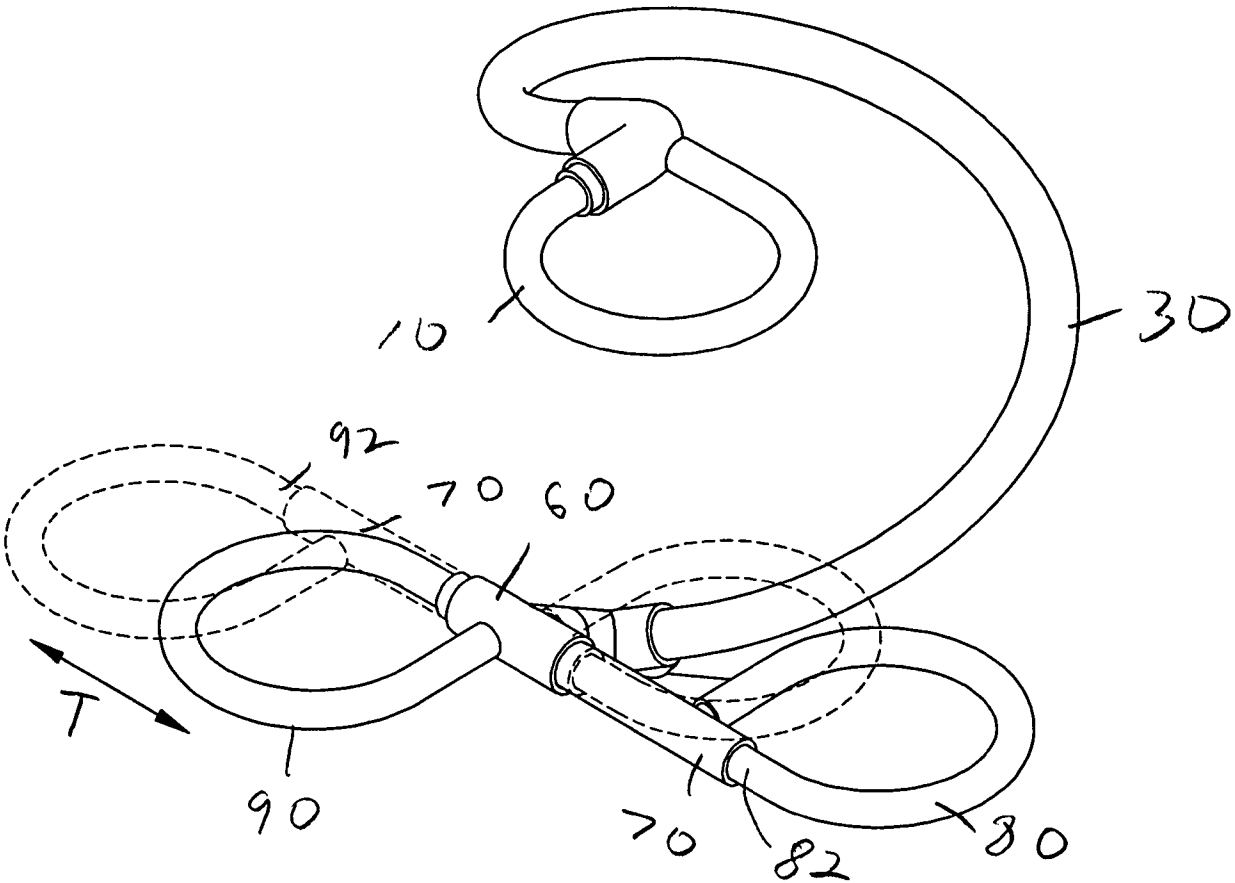
FIG. 26 shows a rear perspective view of the embodiment of the preceding figures with telescoping adjustable loop holders.

FIG. 26 shows a rear perspective view of the embodiment 1 of the preceding figures with telescoping adjustable loop holders 80 and 90. Attachment ends 82, 92 of bottom loop holders 80, 90 can be elongated to telescoping slide in and out in the direction of arrow T into the open ends of t-shaped coupler 60. Alternatively extension couplers 70 can be attached to either or both of the attachment ends 82, 92 of the bottom loop holders 80, 90.

Figure 27:
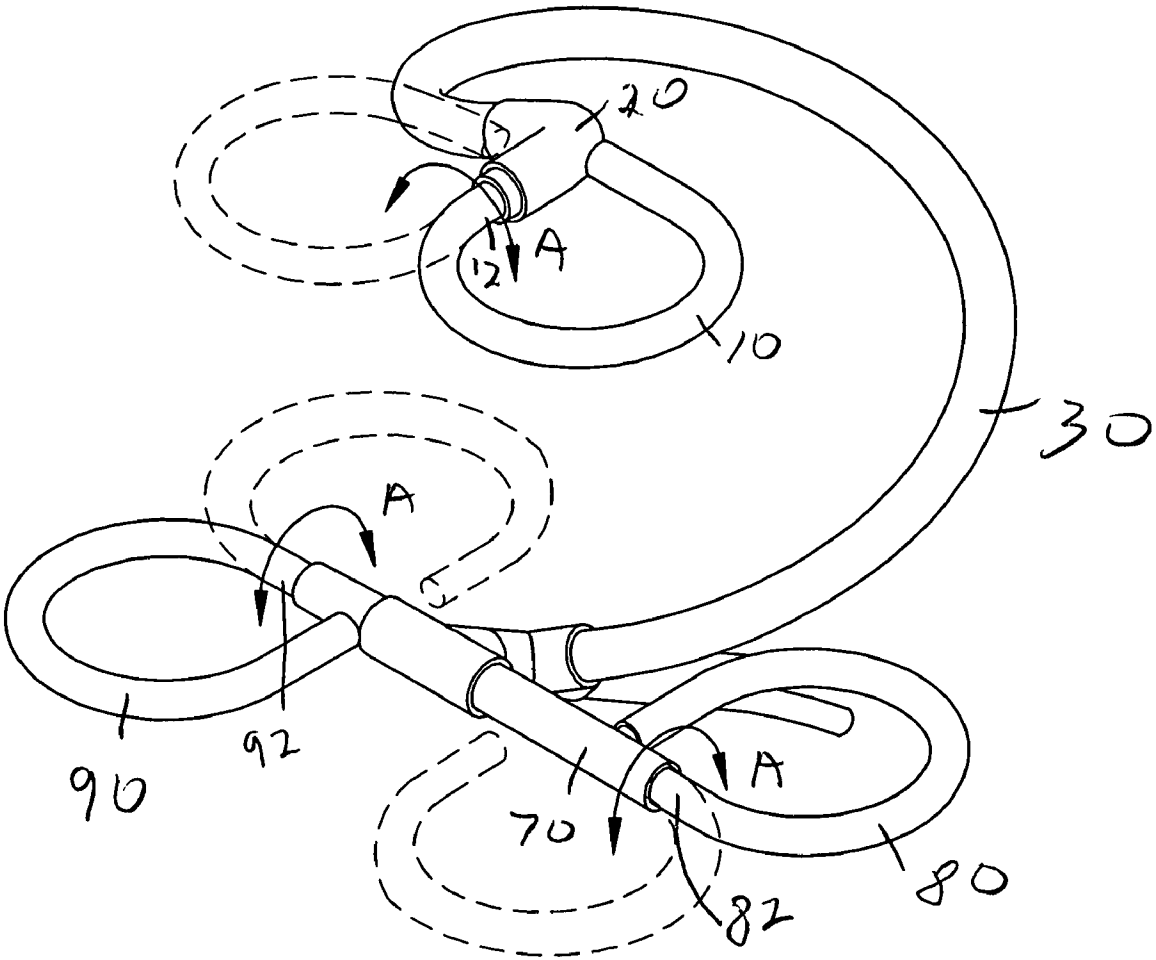
FIG. 27 shows a front perspective view of the preceding embodiment where the loop holders can rotate in the direction of arrow A and be reversible to opposite locations relative to the coil member.

FIG. 27 shows a front perspective view of the preceding embodiment where the loop holders 10, 80, 90 can rotate in the direction of arrow A and be reversible to opposite locations relative to the coil member by their respective attachment ends 12, 82, 92 being able to twist within their respective couplers 20, 70 and 60.

Figure 28:
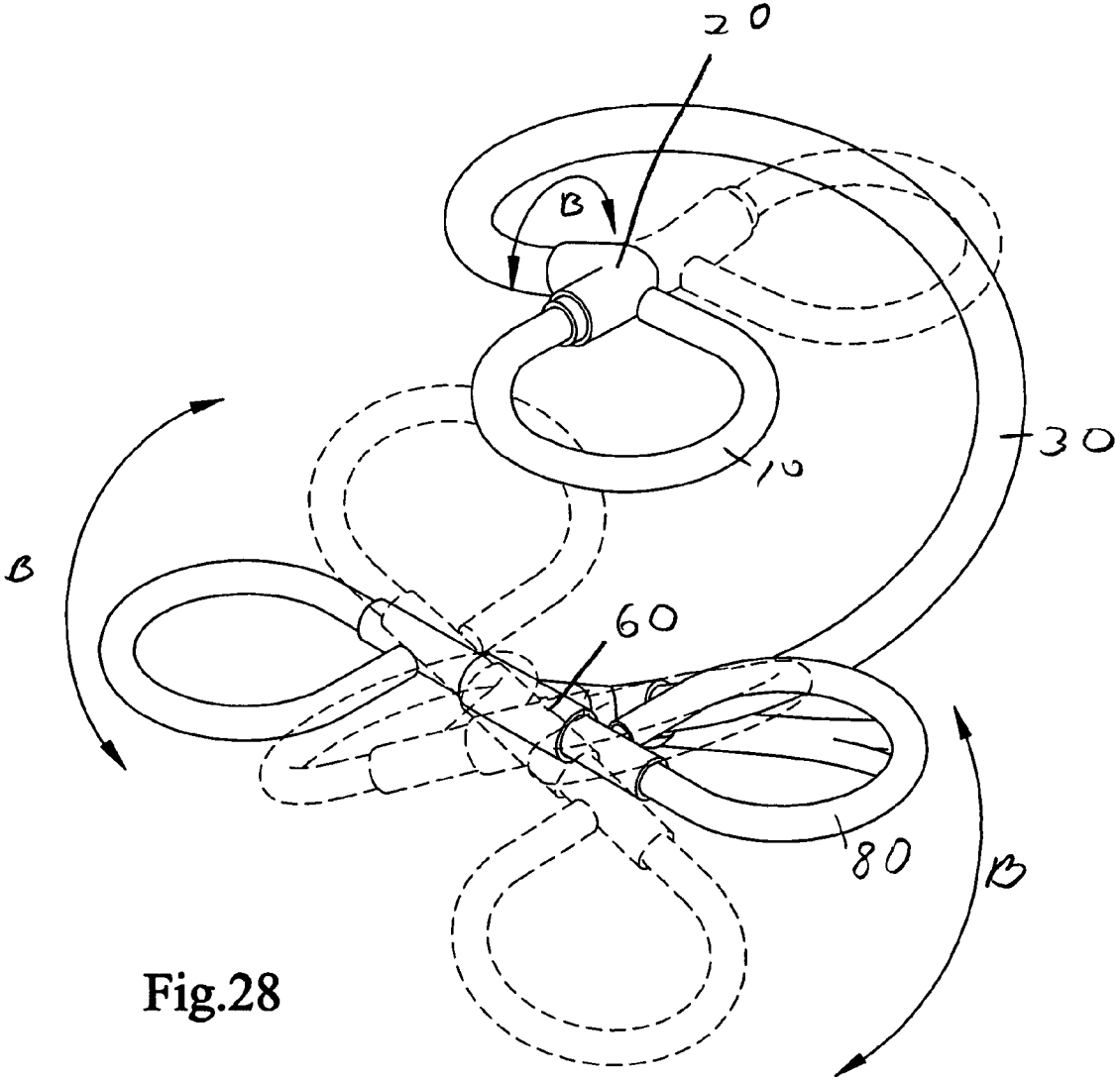
FIG. 28 shows a front perspective view of the preceding embodiment showing further adjustability by moving both the loop holders and their respective couplers in the direction of arrow B.
Figure 30:
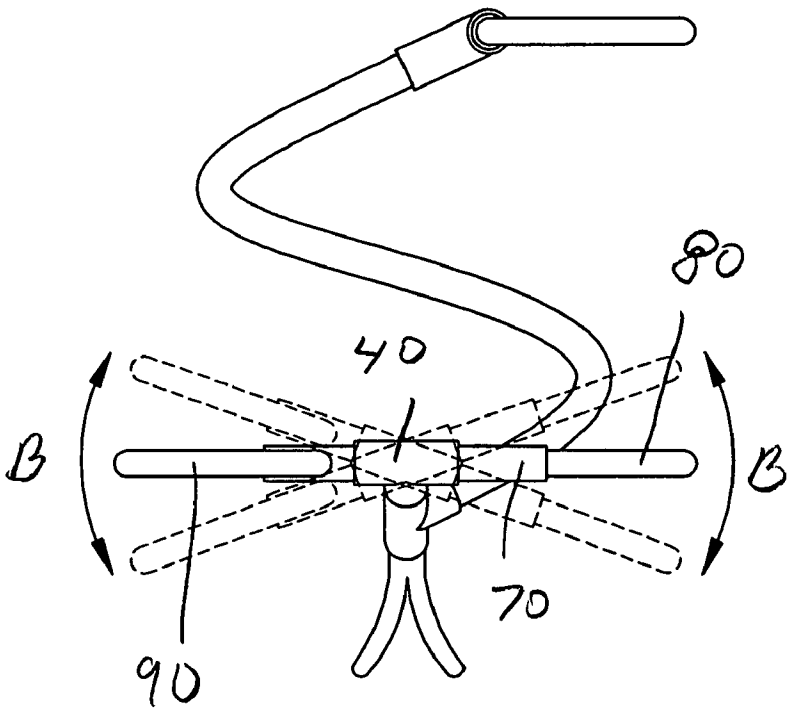
FIG. 30 shows a front view of the adjustability of bottom loops of FIG. 29.
Figure 29:
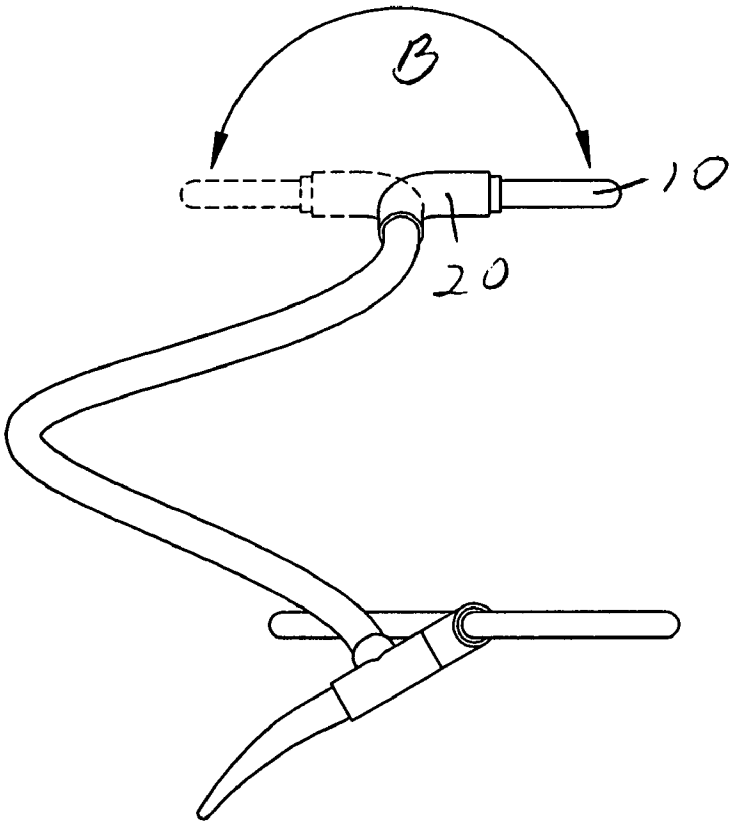
FIG. 29 shows a side view of FIG. 28 showing adjustability of the loop holders, showing that the potholder loops are reversible.

FIG. 28 shows a front perspective view of the preceding embodiment showing further adjustability by moving both the loop holders 10, 80 and 90 together with their respective couplers 20, and 60 in the direction of arrow B so that the loop holder can be adjusted 360 degrees to different orientations for leveling objects to be supported thereon. FIG. 29 shows a side view of FIG. 28 showing adjustability of the loop holders 10, 80 and 90. FIG. 30 shows a front view of the adjustability of bottom loops 80, 90 of FIG. 29. The invention can be adjusted for attachment to various diameter support members.

Figure 32:
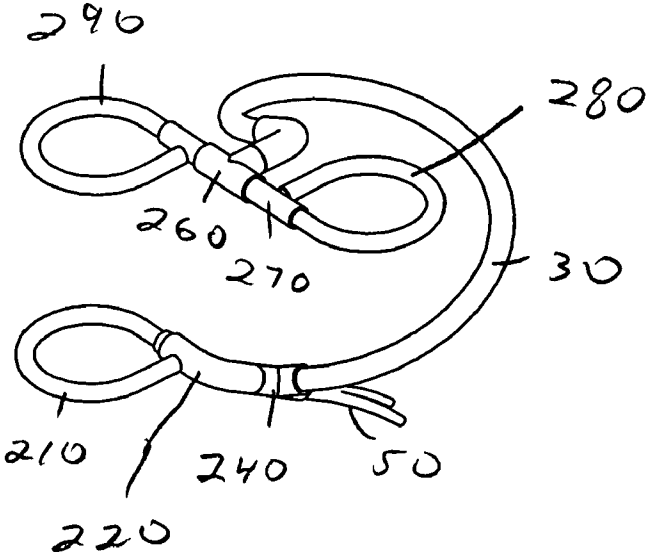
FIG. 32 shows a front perspective view of the stand of FIG. 31 without the supported objects and the underlying support member.
Figure 31:
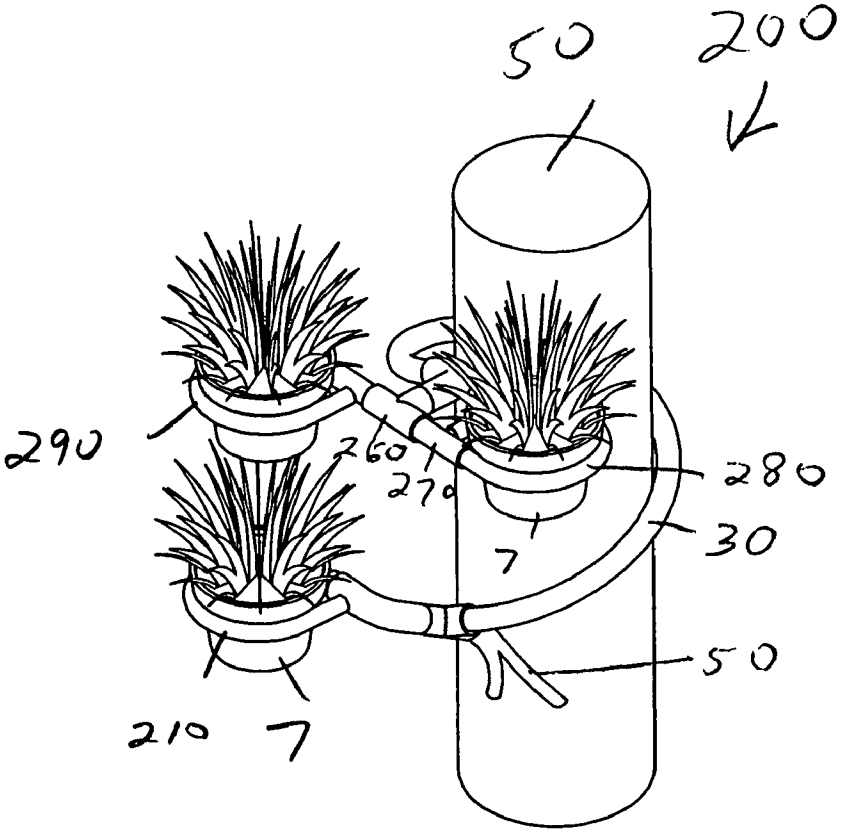
FIG. 31 shows a front perspective of another embodiment with two top loop holders and one loop holder on the bottom of the stand wrapped about an underlying support member.

FIG. 31 shows a front perspective of another embodiment 200 with two top loop holders 280 and 290 and one loop holder 210 on the bottom of the coil shaped member 30 wrapped about an underlying support member 5 that is supporting objects 7. FIG. 32 shows a front perspective view of the stand 200 of FIG. 31 without the supported objects 7 and the underlying support member 5. This embodiment can have an upper left loop holder 280 with extender coupler 270 and upper right loop holder 290 connected by an upper t-shaped coupler to an upper end of the coil member 30. The bottom of the coil member 30 can connect to another t-shaped coupler 240 that also connect a fork stabilizer and single bottom loop holder 210 with curved coupler 220. The second embodiment components can be assembled together with slip fittings similar to that of the preceding embodiment and also be similarly mounted to an underlying support member 5.

Figure 34:
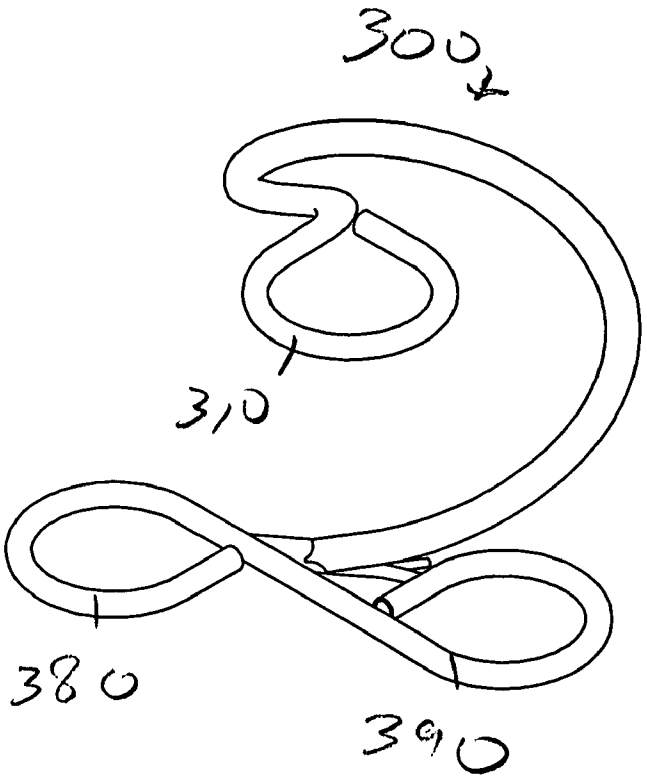
FIG. 34 is a front right perspective view of the embodiment of FIG. 33.
Figure 33:
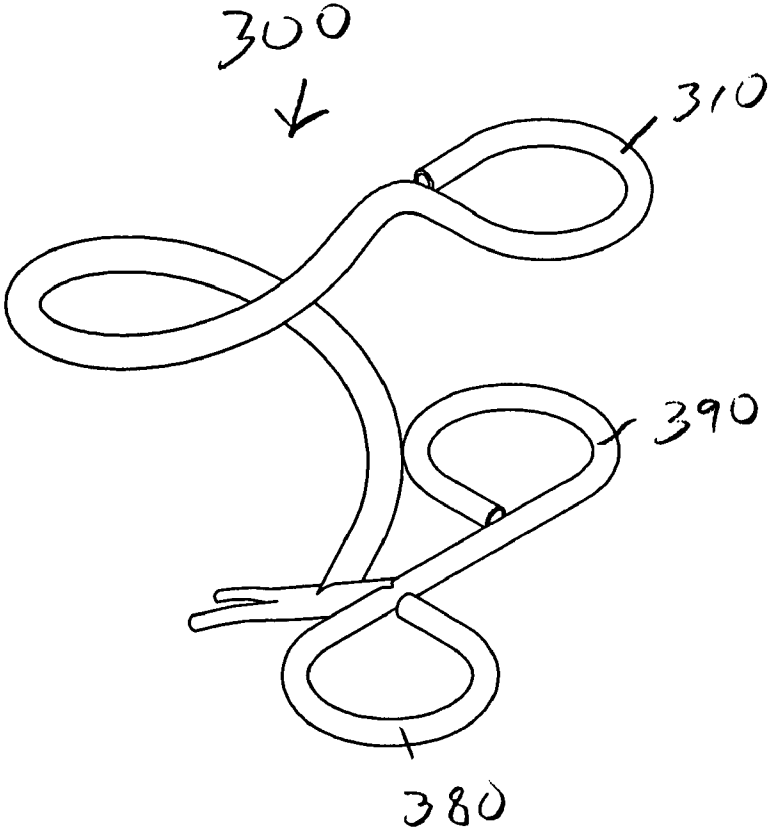
FIG. 33 shows a front left perspective of another embodiment of the stand without coupler connector fittings as single molded piece.

FIG. 33 shows a front left perspective of another embodiment 300 of the stand without coupler connector fittings as single molded piece. FIG. 34 is a front right perspective view of the embodiment 300 of FIG. 33. The invention can be formed and molded from a single pipe member to have a generally coil shaped configuration with upper loop holder 310 and bottom left and right loop holders 380 and 390 in place.

Figure 36:
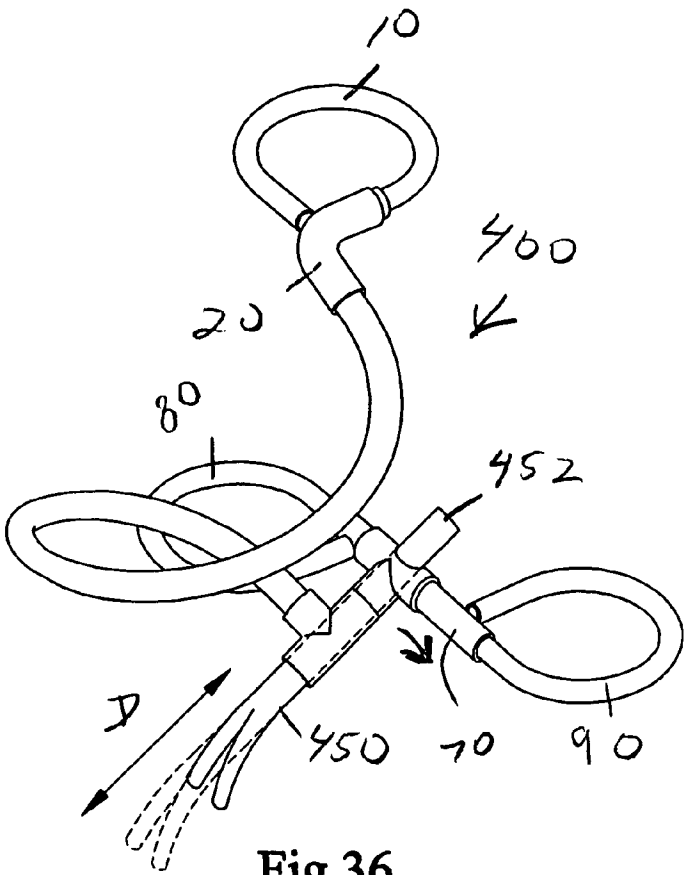
FIG. 36 shows the telescoping adjustability of the fork stabilizer of FIG. 35.
Figure 35:
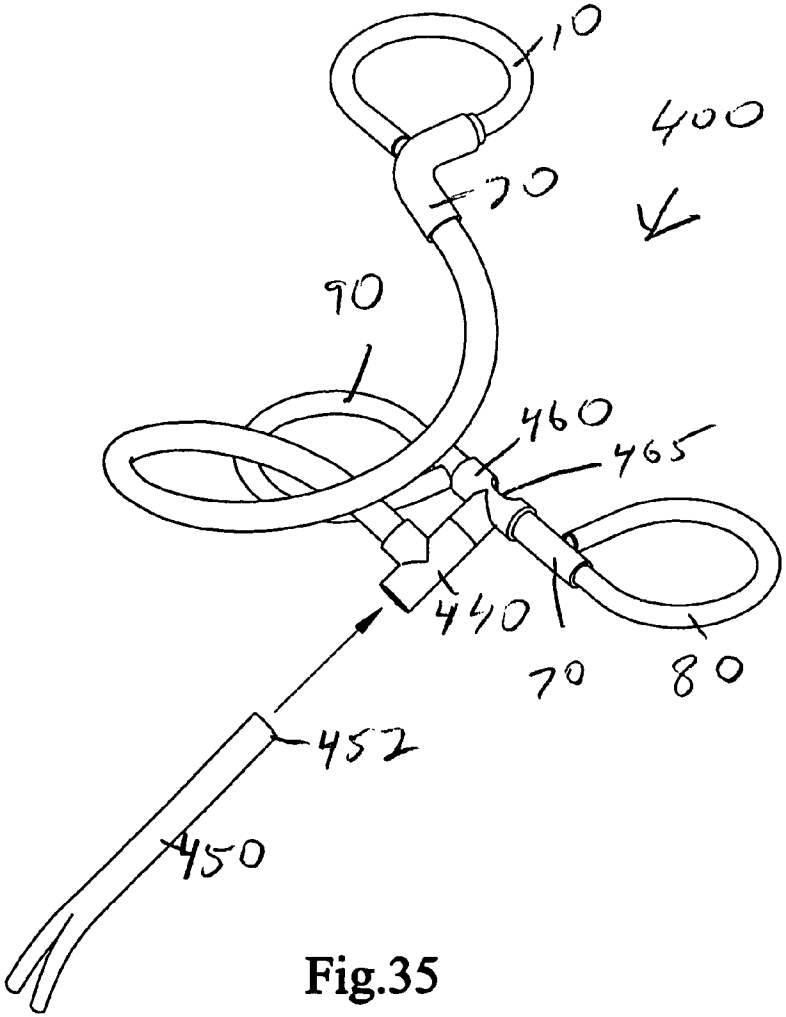
FIG. 35 shows a front right perspective of another embodiment with adjustable, extendable fork stabilizer being installed into main body of unit.
Figure 38:
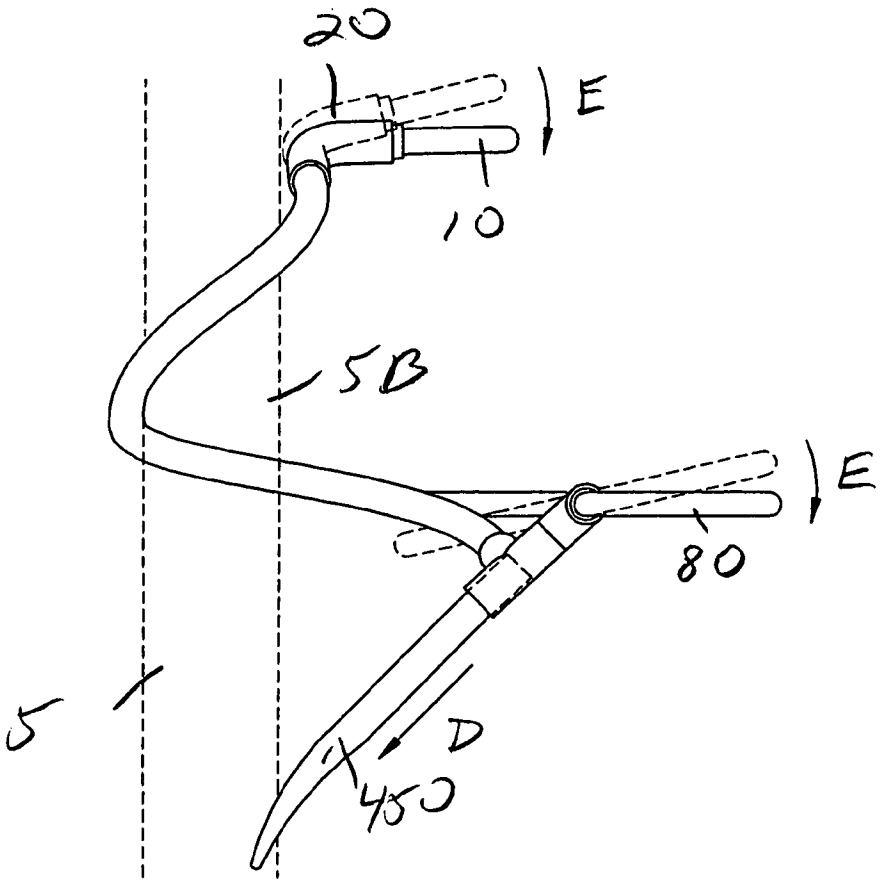
FIG. 38 shows a side view of the fork stabilizer being adjusted for a smaller diameter underlying support member with loop holders being adjusted to be level.
Figure 37:
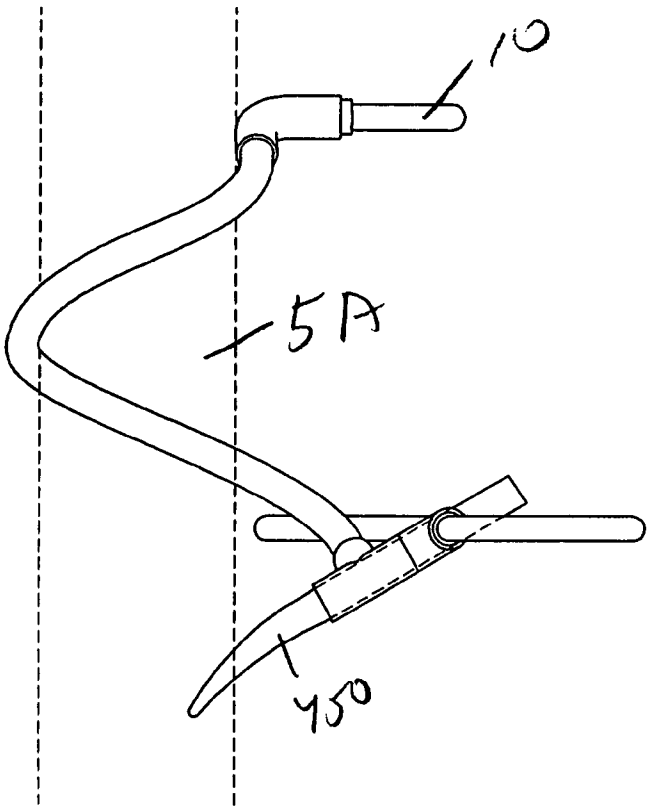
FIG. 37 shows a side view of the fork stabilizer being adjusted for a large diameter underlying support member.

FIG. 35 shows a front right perspective of another embodiment 400 with adjustable, extendable fork stabilizer 450 being installed into t-shaped couplers 440, 460. FIG. 36 shows the telescoping adjustability of the fork stabilizer 450 of FIG. 35 with coupler 70 having an optional side through-hole. FIG. 37 shows a side view of the fork stabilizer 450 being adjusted for a large diameter underlying support member 5A. FIG. 38 shows a side view of the fork stabilizer 450 being adjusted for a smaller diameter underlying support member with loop holders 10, 80 being adjusted to be level.

Referring to FIGS. 35-38, the novel stabilizer 450 can have an elongated outer end 452 that can insert into and through opposite facing ends of t-shaped coupler and pass out a pass-through opening 465 in the modified t-shaped coupler 460. The telescoping adjustable stabilizer 450 has additional versatility over the previously described stabilizer to allow loop holders 20, 80, 90 to be able to rotate and twist relative to their respective couplers and be moved to a level orientation.

Figure 39:
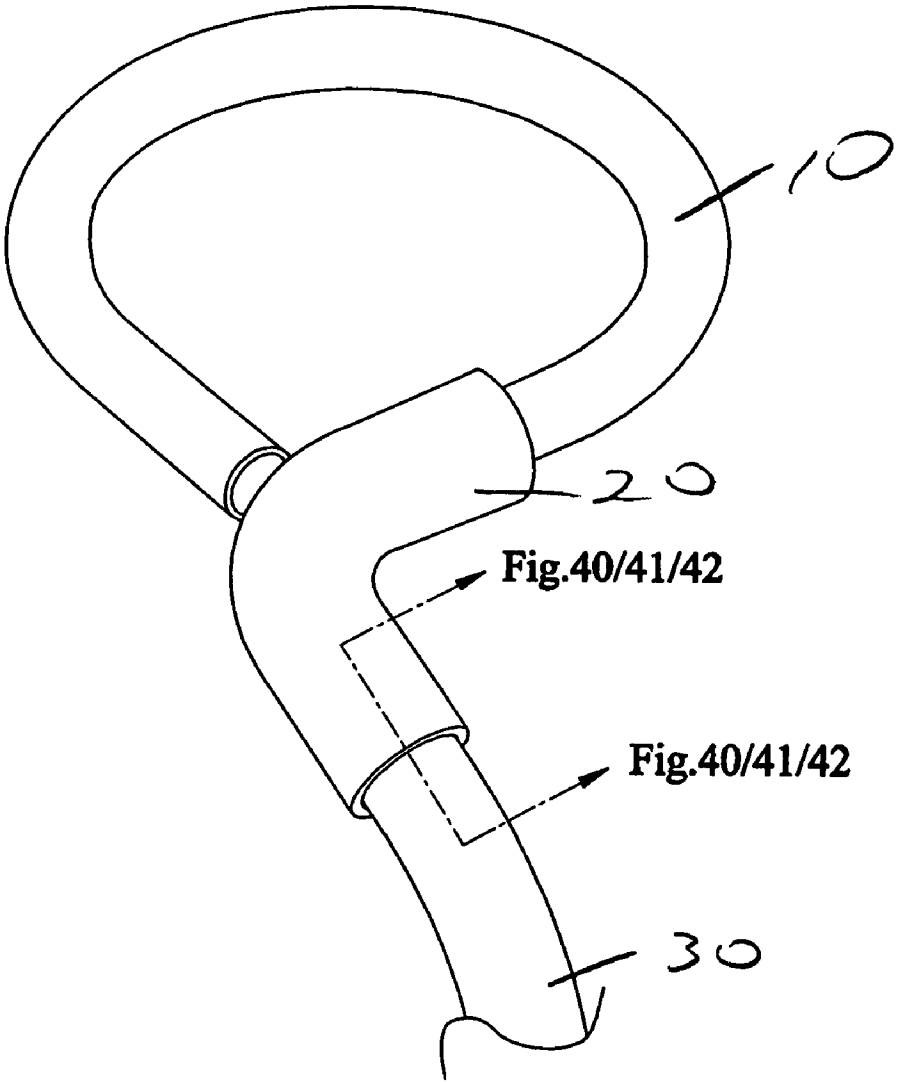
FIG. 39 is an enlarged upper perspective view of the top loop holder of the invention.
Figure 40A:
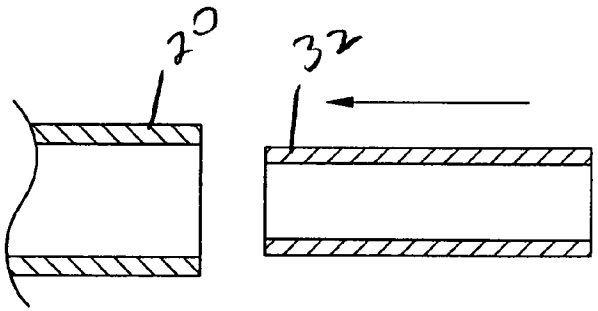
FIGS. 40A and 40B show cross-sectional views of FIG. 39 with slip connections.
Figure 40B:
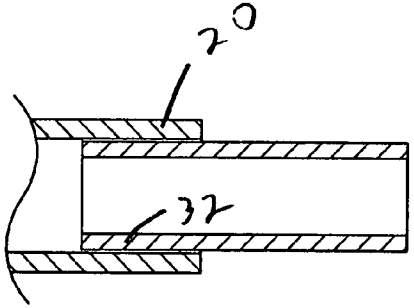

FIG. 39 is an enlarged upper perspective view of the top loop holder 10 of the invention. The components of the embodiments can be connected with one another by various different types of connection arrangements. FIGS. 40A and 40B show cross-sectional views of FIG. 39 with slip connections between end coil end 32 and. As previously described a tight slip fit connection can be accomplished with the invention, and adhesive such as glue can be further applied to lock the components to one another.

Figure 41A:
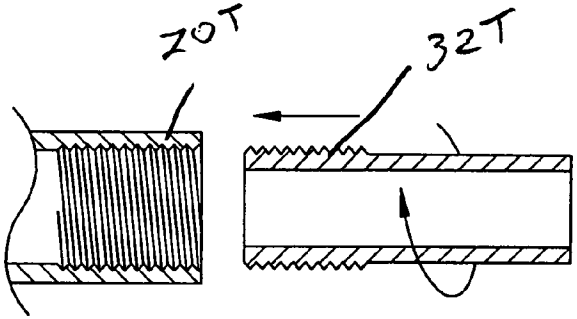
FIGS. 41A-41B show cross-sectional views of FIG. 39 with male/female threaded connections.
Figure 41B:
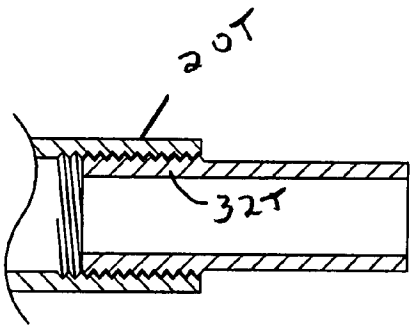

FIGS. 41A-41B show cross-sectional views of FIG. 39 with male/female threaded connections 20T and 32T with allows components to attach to one another by rotating to locked position.

Figure 42A:
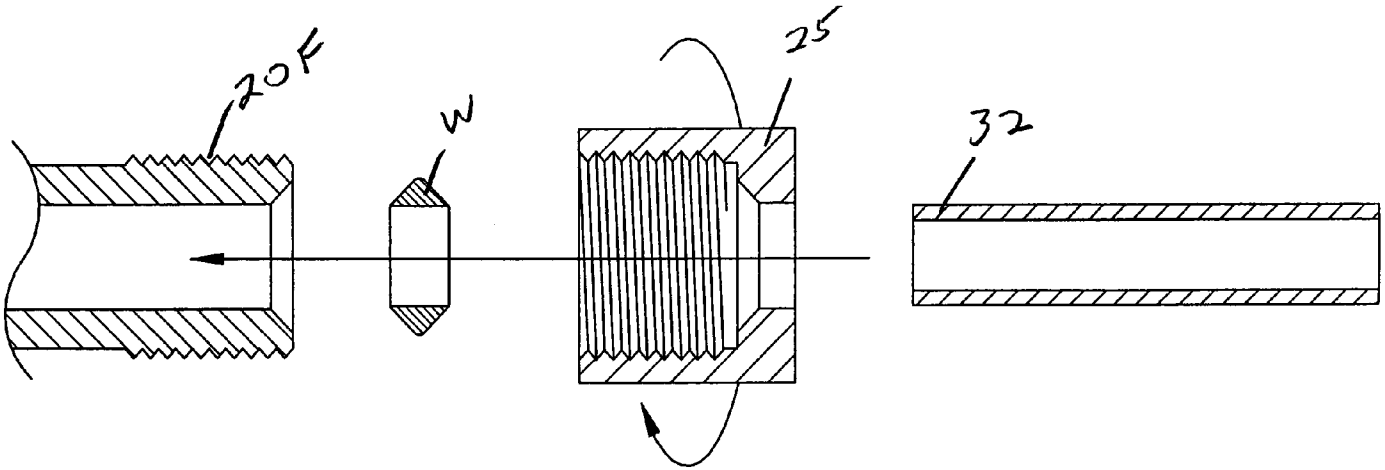
FIGS. 42A-42B show cross-sectional views of FIG. 39 with compression fitting connections.
Figure 42B:
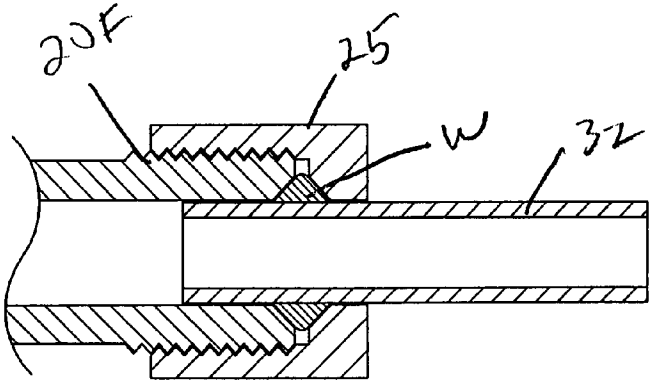

FIGS. 42A-42B show cross-sectional views of FIG. 39 using another connection arrangement of compression fitting connections. Here, the outer perimeter of the coupler 20 can be threaded 20F. The upper end 32 of the coil member can be inserted through an opening in compression cap 25 which has threads to tighten about threads 20F with a resilient washer W that can compress and lock the components to one another.

Figure 44:
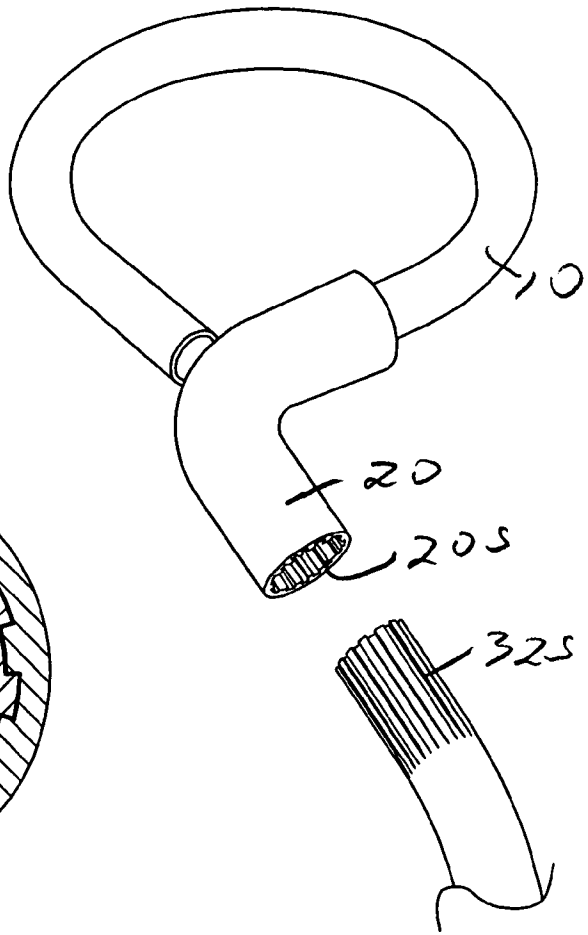
FIG. 44 shows an exploded view of the components of the spline fit assembly.
Figure 43A:
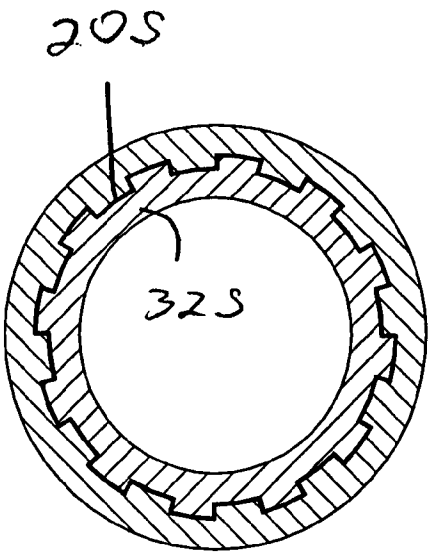
FIG. 43A is a cross-sectional view of the spline fit assembly of FIG. 43 along arrow 43A.
Figure 43:
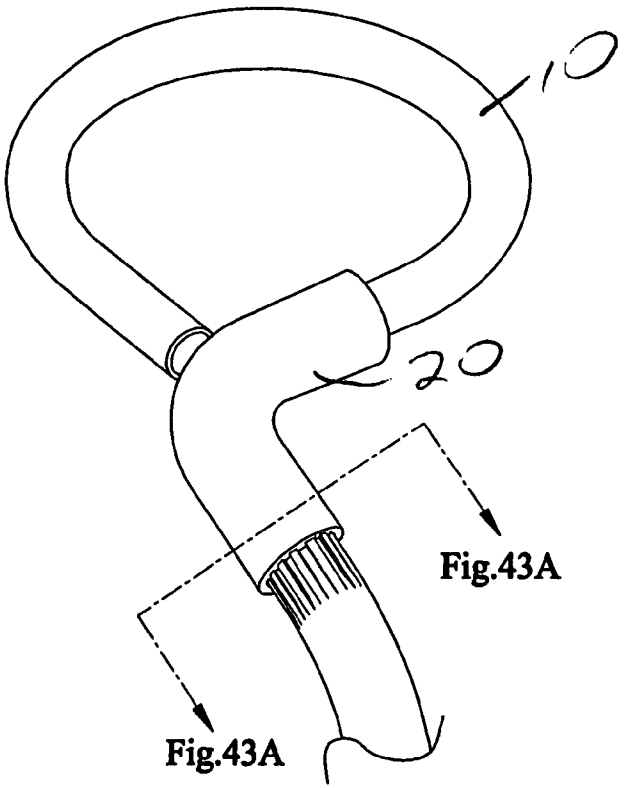
FIG. 43 shows an upper perspective of the top loop holder of the preceding embodiments with spline fit assembly.

FIG. 43 shows an upper perspective of the top loop holder of the preceding embodiments with spline fit assembly. FIG. 43A is a cross-sectional view of the spline fit assembly of FIG. 43 along arrow 43A. FIG. 44 shows an exploded view of the components of the spline fit assembly. Here, raised ridges and grooves in the mating components 205 and 32S allow the components to mateably lock to one another.

Figure 45:
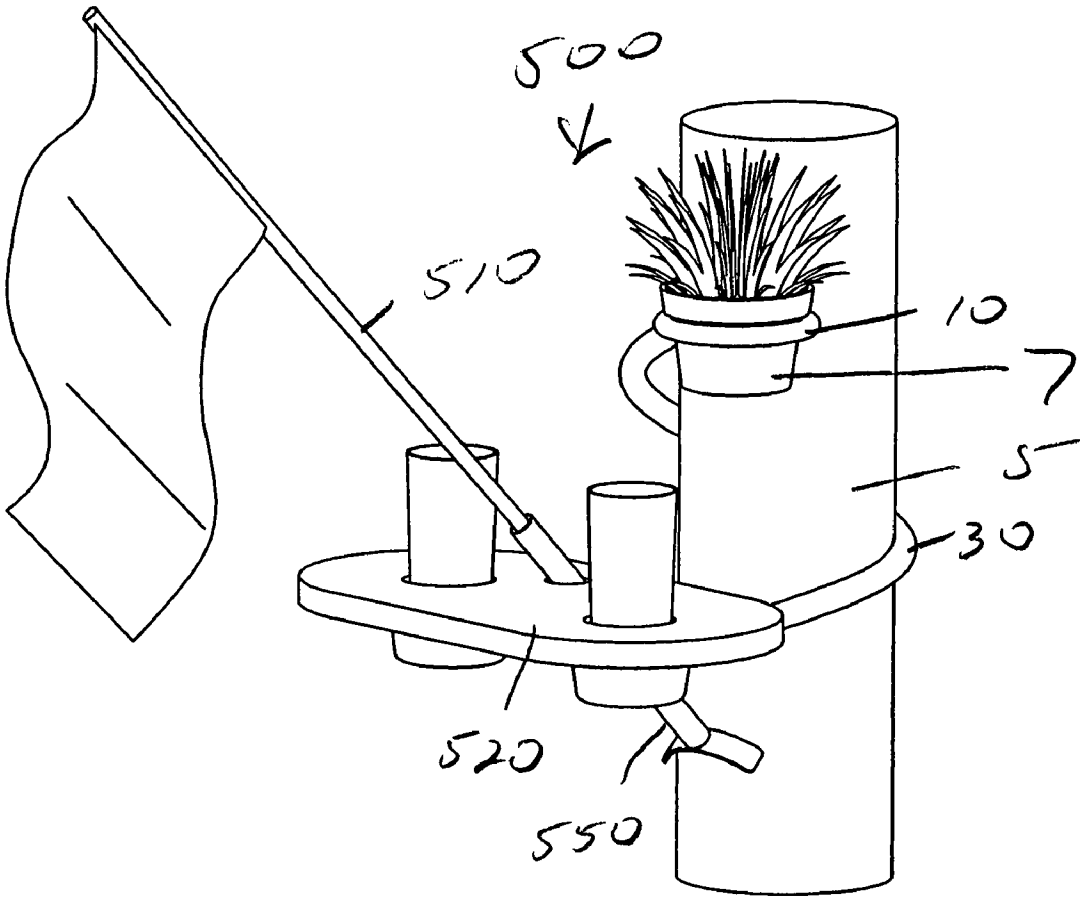
FIG. 45 shows a front perspective of an optional table mounted embodiment with adjustable stabilizer shown piercing table and being used as a flag holder.
Figure 46:
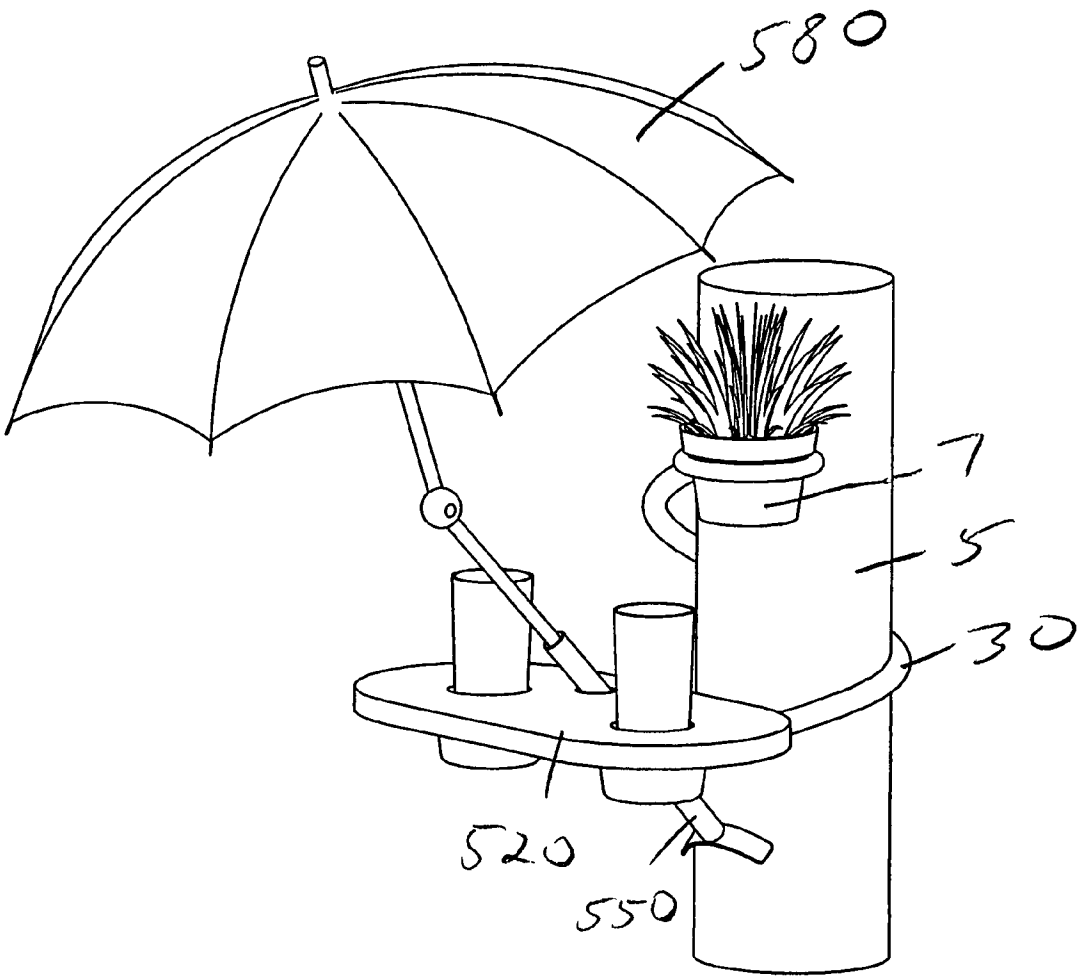
FIG. 46 is another view of FIG. 45 with an umbrella.
Figure 48:
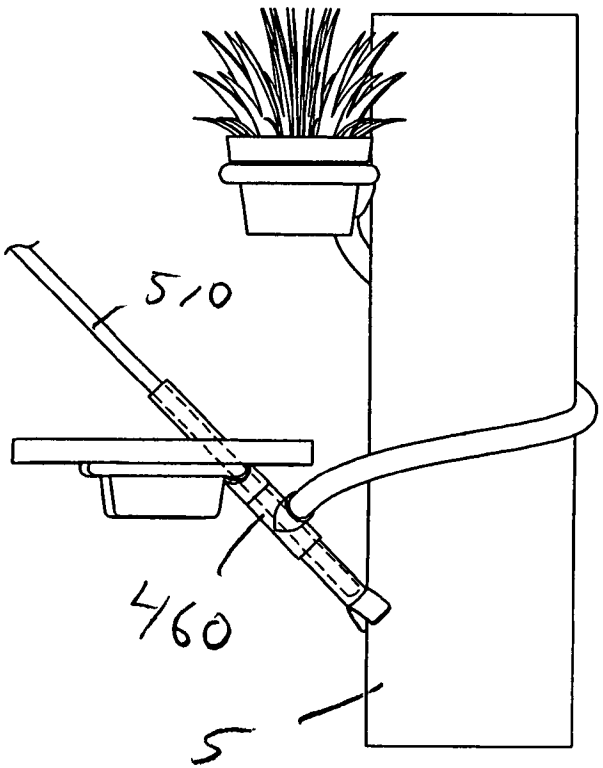
FIG. 48 shows a side view of the table embodiment.
Figure 47:
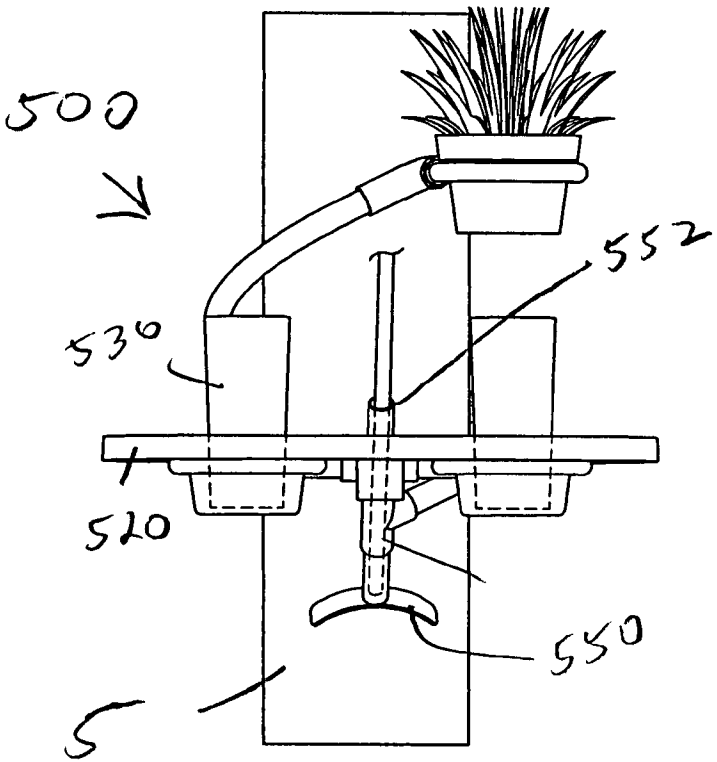
FIG. 47 shows a front view of the table embodiment.
Figure 50:
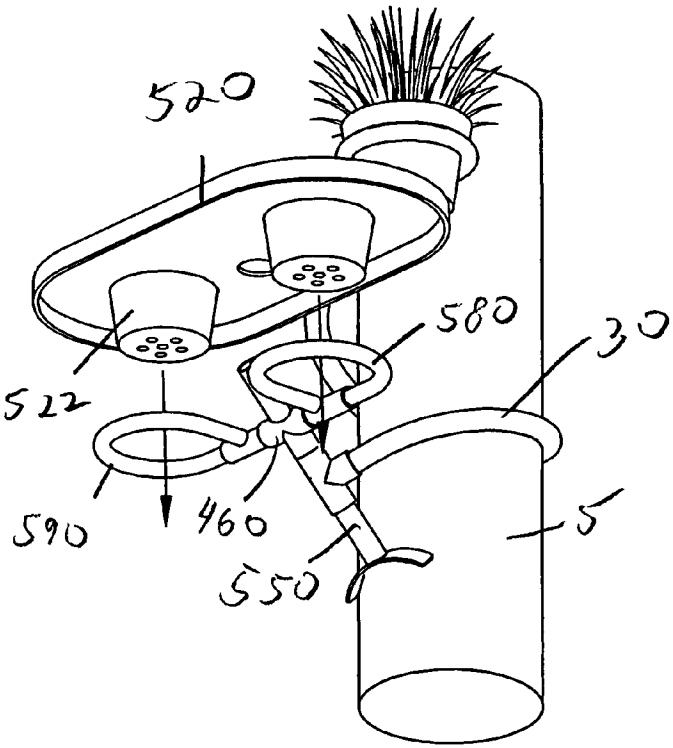
FIG. 50 shows a lower front exploded perspective view of FIG. 49.
Figure 49:
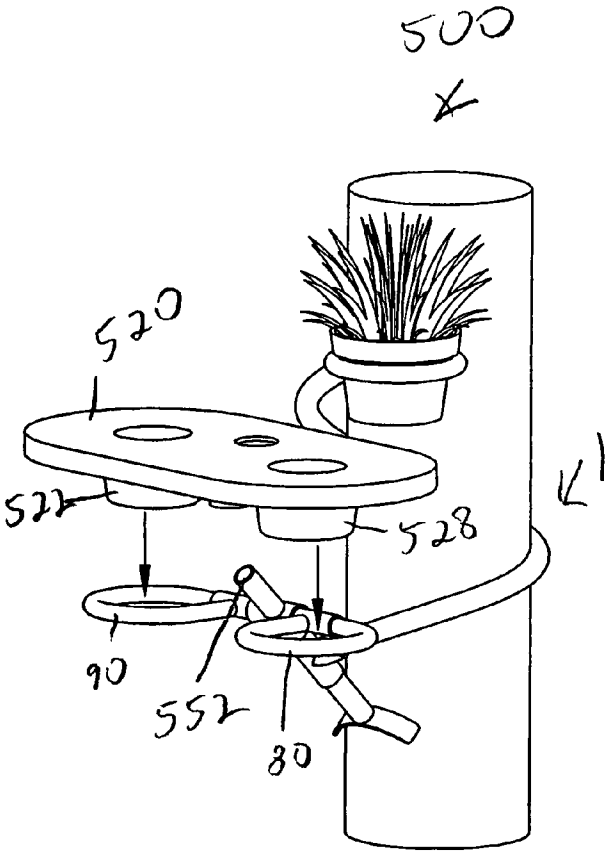
FIG. 49 shows a top front exploded perspective view of the table separated from the stand.

FIG. 45 shows a front perspective of an optional table mounted embodiment 500 with adjustable stabilizer 550 shown piercing table 520 and being used as a holder for a flag 510. FIG. 46 is another view of FIG. 45 with an umbrella 580. FIG. 47 shows a front view of the table embodiment 500. FIG. 48 shows a side view of the table embodiment 500. FIG. 49 shows a top front exploded perspective view of the table 520 being separated from the stand 1. FIG. 50 shows a lower front exploded perspective view of the table embodiment 500 of FIG. 49.

Referring to FIGS. 45-50, the invention can use a stabilizer 550 with the modified t-shaped coupler 460 similar to that shown and described in the previous figures to adjust the stand 1 so that the bottom loop holders 80, 90 are level. The upper end of the stabilizer 550 can have an opening 552 to allow a flag pole 510 to be supported therein. Alternatively, the opening 552 can receive an umbrella 580.

The novel embodiment can modify the invention so that the bottom loop holders 80, 90 can receive the lower extending portions 522, 528 of a table 520, the latter of which can support beverages such as cans, bottles and glasses on indentations thereon.

Each of the components shown in the figures can be formed from PVC type pipes, ABS plastic, polycarbonate, PPSF and blends, complex materials, wood, fiberglass, ceramics, glasses, polymers, electropositive elements (chrome, electroplated materials), and/or metals, various combinations thereof, and the like. The pipe sections can have diameters ranging from approximately ½ inch up to 3½ inches, and more when desired.

The novel stands can be white, green, black or be any other decorative color such as but not limited to red, white and blue, combinations, thereof, and./or have other decorative indicia thereon.

Although the loop holders in the figures appear similar in size with similar diameter openings, the invention can be practiced with smaller and larger loop diameter openings and combinations of different sized loops, and the like.

While the components shown are generally cylindrical shaped pipe members, the invention can use other shaped pipe type pieces such as but not limited to square shaped pipes, hexagon shaped pipes, triangular shaped pipes, and the like.

Although the preferred embodiments show a single loop holder on top of the main coil member and two loop holders on the bottom, the invention can be used with two loop holders on top and one loop holder on bottom. Additionally, additional loop holders can be added or removed from the coil member as desired.

While the preferred embodiments are generally covering outdoor applications, the invention can also be used indoors as well.

Although holder rings are shown and described for supporting pots and planters, other shaped configurations such as a rectangular frame can be used for supporting rectangular planter boxes, and the like, as well as other geometrical shapes such as but not limited to triangles, hexagons, ovals, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A stand for supporting objects above ground level, comprising:

a coil member being substantially rigid and slightly flexible that is adaptable to wrap in a spiral configuration about an elongated underlying support, the member having a lower end and an upper end;

a t-shaped coupler having an end attached to the lower end of the coil member;

a fork shaped end attached to another end of the t-shaped coupler for stabilizing the coil member against the elongated underlying support; and a holder attached to still another end of the t-shaped coupler for supporting an object above ground level.

2. The stand of claim 1, further comprising:

a coupler having a threaded end.

3. The stand of claim 1, further comprising:

a coupler having a compression fitting end.

4. The stand of claim 1, wherein the holder includes a ring shape.

5. The stand of claim 1, wherein the holder includes a table.

6. The stand of claim 1, wherein the object is selected from at least one of: a pot and a planter.

7. The stand of claim 1, wherein the object is selected from at least one of: a can, a bottle and a glass.

8. The stand of claim 1, wherein the object is a flag pole.

9. The stand of claim 1, wherein the elongated underlying support is selected from at least one of: a tree trunk and a tree limb, a pole, a post, a vertical column, pillar and vertical upright.

10. The stand of claim 1, wherein the elongated underlying support is selected from at least one of a railing and a banister.

11. The stand of claim 1, further comprising:

a second holder attached to the upper end of the coil member, the second holder for supporting a second object above the ground level, the second holder being separate from and spaced apart from the first holder, the second object being separate from and spaced apart from the first object.

12. A stand for supporting objects above ground level, comprising:

a coil member being substantially rigid and slightly flexible that is adaptable to wrap in a spiral configuration about an elongated underlying support, the member having a lower end and an upper end;

a t-shaped coupler having an end attached to the lower end of the coil member;

a yoke shaped member having an upper end attached to another end of the t-shaped coupler, the yoke shaped member having a lower end with a curved surface for stabilizing the coil member against the elongated underlying support; and a holder attached to still another end of the t-shaped coupler for supporting an object above ground level.

13. The stand of claim 12, further comprising:

a depressible pad attached to the curved surface of the yoke shaped member for allowing for a tighter fit against the underlying support.

14. The stand of claim 12, further comprising:

a second holder attached to the upper end of the coil member, the second holder for supporting a second object above the ground level, the second object being separate from and spaced apart from the first object.

15. A stand for supporting objects above ground level, comprising:

a coil member being substantially rigid and slightly flexible that is adaptable to wrap in a spiral configuration about an elongated underlying support, the member having a lower end and an upper end;

a t-shaped coupler having an end attached to the lower end of the coil member;

a spike shaped member having an upper end attached to another end of the t-shaped coupler, the spike shaped member having a lower end with an angled surface for stabilizing the coil member against the elongated underlying support; and a holder attached to still another end of the t-shaped coupler for supporting an object above ground level.

16. The stand of claim 15, further comprising:

a second holder attached to the upper end of the coil member, the second holder for supporting a second object above the ground level, the second object being separate from and spaced apart from the first object.

17. A stand for supporting objects above ground level, comprising:

a coil member being substantially rigid and slightly flexible that is adaptable to wrap in a spiral configuration about an elongated underlying support, the member having a lower end and an upper end;

a first holder attached to the upper end of the coil member for supporting a first object above ground level;

a second holder attached to the lower end of the coil member for supporting a second object above the ground level;

t-shaped coupler attached to the lower end of the coil member, the second holder being attached to another end of the t-shaped coupler; and a third holder attached to still another end or the t-shaped coupler, the third holder for supporting a third object above the ground level.

18. The stand of claim 17, further comprising:

a second t-shaped coupler attached to the lower end of the coil member; and a stabilizing member having an upper end attached to the second t-shaped coupler, the stabilizing member having a lower end for stabilizing the coil member against the elongated underlying support.

* * * * *